US010399208B1

(12) United States Patent
Juranitch

(10) Patent No.: US 10,399,208 B1
(45) Date of Patent: Sep. 3, 2019

(54) PROTECTED BLADE EDGE KNIFE SHARPENING APPARATUS

(71) Applicant: Razor Edge Systems, Inc., Ely, MN (US)

(72) Inventor: Joseph C. Juranitch, Babbitt, MN (US)

(73) Assignee: Razor Edge Systems, Inc., Ely, MN (US)

( * ) Notice: Subject to any disclaimer, the term of this patent is extended or adjusted under 35 U.S.C. 154(b) by 66 days.

(21) Appl. No.: 15/610,169

(22) Filed: May 31, 2017

(51) Int. Cl.
*B24B 3/54* (2006.01)
*B24D 15/08* (2006.01)

(52) U.S. Cl.
CPC ..... *B24D 15/081* (2013.01)

(58) Field of Classification Search
CPC ..... B24B 3/54; B24B 3/50; B24B 23/00
USPC ..... 451/45, 349, 555, 486, 321, 312; 76/82, 76/86, 88
See application file for complete search history.

(56) References Cited

U.S. PATENT DOCUMENTS 4,934,110 A * 6/1990 Juranitch ..... B24D 15/081 451/486
5,478,272 A * 12/1995 Cozzini ..... B24D 15/081 451/486
5,655,959 A * 8/1997 Juranitch ..... B24D 15/081 451/486
6,866,569 B2 * 3/2005 Cozzini ..... B24D 15/081 451/319
7,503,241 B2 * 3/2009 Dassaud ..... B24D 15/081 451/486
9,545,703 B1 * 1/2017 Juranitch ..... B24D 15/081

* cited by examiner

*Primary Examiner* — Robert A Rose
(74) *Attorney, Agent, or Firm* — DeWitt LLP

(57) ABSTRACT

A sharpening apparatus that may be used by a relatively unskilled person to simultaneously sharpen the two opposed cutting edges of a knife blade by hand and to maintain a sharpened cutting edge along the blade with minimal effort and training is provided by the invention. The apparatus comprises a panel member with a slot partially extending from its top edge, and a pair of sharpening steels that are pivotably mounted to the panel member to swing downwards in a crossed relation across the slot. A pair of counterweights or leaf springs biases the sharpening steels into their standby position. When the knife blade is moved down through the slot, it comes into contact with crossed sharpening steels to bow them outwards under tension applied by the leaf springs. The cutting edges of the knife blade are drawn along and against the sharpening steels to automatically sharpen their cutting edges at the proper angle without any need to match angles between the cutting edges of the knife and the sharpening steels, and without any counterweights applied to the sharpening steels. One or more secondary steeling rods are attached to the edges of the slot in the panel member to guide the knife blade in proper orientation with the sharpening steels as the knife blade travels in the slot of the panel member, and to protect the knife blade contacting the edges of the slot that might otherwise damage and knife blade. Such a sharpening apparatus can be used to maintain an extremely sharp cutting edge for precise cutting of a material without crushing or other damage with significantly reduced physical force and strain upon the user.

36 Claims, 14 Drawing Sheets

PROTECTED BLADE EDGE KNIFE SHARPENING APPARATUS

FIELD OF INVENTION

This invention relates to an apparatus for sharpening the cutting edge of a knife blade and maintaining a sharp edge along the cutting edge, and more specifically to such an apparatus that protects the blade edge from deformation while it is being sharpened and polished.

BACKGROUND OF THE INVENTION

A knife represents a hand-held cutting tool with a cutting edge or blade. It may also have a handle. Originally made from rock, bone, flint, or obsidian, knife blades today are typically fashioned from iron, steel, ceramics, or titanium.

While knives may be used as a weapon, they are more commonly employed by people as useful tools in food preparation, dining, meat processing, hunting, construction, work projects, and hobbies for cutting or slicing an object. Many different types and designs of knives are known, but most of them share the trait of one or two sharpened blade edges.

But, over time, these sharpened edges of the knife blade will become dull or damaged. Blades are damaged usually by buckling due to compressive force arising from the user pressing the knife blade edge into a hard object like bone, ice, a hard cutting board, or other hard object, or simply by repetitive use. The cutting edge may also become bent from sideways pressure applied against the blade. Both of these forces tend to roll the knife blade's cutting edge due to the ductile characteristic of the metal material used in the blade. Moreover, tougher or abrasive materials will cause the blade to become dull more quickly.

Dull blades do not cut as easily or precisely, and can create a danger to the end user by requiring greater hand force to make a cut. Moreover, dulled blades can include burrs or ragged edges with regions along the cutting surface that are out of alignment with each other. Such misaligned blades can damage the material being cut, or produce an inferior cut by tearing or sawing the material being cut as opposed to a smooth, clean cut.

Therefore, such dulled knife blades must be periodically sharpened. This is a process in which the knife blade is ground against a hard, rough surface like a stone, or a soft surface containing hard particles. Metal can be removed from the knife blade in order to form a new edge along the blade. Typically, a grinding wheel or a whetstone is used. These sharpening stones come in varying grit degrees from very coarse to very fine, and can be described as hard or soft depending upon whether the grit comes free of the stone during the grinding operation. Ceramic hones are also commonly used, especially when fine grit size is desired. Coated hones with an abrasive diamond-based surface provide yet another option. Mineral oil often is used during the grinding application to separate the loosened grinding particles from the knife blade edge to prevent damage to the blade.

The cutting edges of the knife blade may also be straightened by a sharpening steel. The sharpening steel constitutes a hardened cylindrical, triangular or other shaped rod having a small diameter. This sharpening steel may have a smooth, polished exterior surface, or may be somewhat abrasive. It may also feature slight ridges or ribs running along the length of the rod. A butcher steel constitutes a round file with teeth running the long way, although it may also be smooth. As the knife blade with its cutting edge is swiped along the sharpening steel, the steel will exert high localized pressure against the cutting edge to straighten the turned edges of the cutting edge back into proper alignment. Unlike grinding, such steeling process does not usually remove metal from the blade edge.

Knives used by barbers are often stropped after steeling in order to polish the sharpened cutting edge. This is often done with a leather strap impregnated with an abrasive compound like chromium (III) oxide particles. This operation does not remove any metal material from the blade edge, but produces a very sharp edge.

However, grinding constitutes a precise operation in which the angle of the cutting edge of the blade must match the angle of the whetstone or grinding wheel surface. The smaller the angle between the blade and stone, the sharper the knife will be, but at the same time, less side force is required to damage the knife blade by bending the cutting edge over or even chipping it off. The edge angle represents the angle between the blade and the stone. For symmetrical double-ground, wedge-shaped knife blades, the angle from one edge to the other edge of the blade will be twice the edge angle.

While steeling represents a less aggressive form of sharpening than grinding, it still is important to swipe the knife's blade at a proper angle with respect to the sharpening steel. Moreover, the two cutting edges of the knife must be swiped the same number of times against the steel or else the cutting edge will be pushed again out of alignment.

It is therefore easy to damage the cutting edge of the knife blade further if the sharpening exercise is performed poorly. Thus, most knife users need to send out their dulled knives to a professional sharpening service, or to replace the knife with a new knife. This can be time-consuming and expensive.

Some knife users employ the bottom of a ceramic coffee mug for sharpening the blade. The course ceramic particle surface can produce acceptable results, although a sharpening steel usually must then be used. But again, a proper angle must still be maintained during the sharpening swipes. Electric knife sharpeners are also available in the market.

U.S. Pat. No. 3,942,394 issued to Juranitch in 1976 is directed to a finishing sharpener device used in the field for sharpening a knife blade. It includes a handle having a pair of wings that fold out and extend at a 30 degree angle from the handle. Each of the wings constitutes a flat bar defining a sharpening edge that is arcuate in cross section and smooth. By drawing a dulled knife blade cutting edge across the sharpening edge of one of the wings at the proper angle, the cutting edge along one side of the knife blade may be restored to its sharpened configuration. The handle of the finishing sharpener serves as a rough visual guide for properly aligning the knife handle to draw the knife blade along the wing's sharpening edge. But, this process still requires some skill by the person sharpening the knife blade to ensure a proper match between the knife blade cutting edge angle and the angled surface of the sharpening edge of the wing. Moreover, the opposing cutting edges of the knife blade must be sharpened sequentially using first the one wing and then the other wing. Simultaneous sharpening of the opposed cutting edges of the knife blade is impossible. Furthermore, when the knife blade is swiped along one of the wings to sharpen it, the blade comes very close to the user's other hand on the handle, thereby producing a risk of injury. Finally, the arcuate cross-section surface of relatively small radial extent having a highly smooth configuration is insufficient for removing material from the cutting edge of the knife blade. This finishing sharpener may only therefore be used after the knife blade has been sharpened first on a hone or grinding wheel.

Razor Edge Systems of Ely, Minn. has commercialized a knife sharpening device referred to as MOUSETRAP STEEL that is further disclosed in U.S. Pat. No. 5,655,959 issued to Juranitch in 1997. It has been used to sharpen the cutting edges of a knife blade in the meat processing industry, but also for any other end-use application where there is a need to maintain a sharp knife edge. It constitutes a bench-top mounted vertical base member having a vertical slot partially bisecting the base member from its top edge. Pivotably mounted to the base member are two counterweights having equal masses. A pair of upwardly curved sharpening steels are connected to the upper and inner ends of the counterweights and extend toward each other in a crossed relationship, intersecting at and along the slot. A pair of guard rods are needed to protect the sharpening steels from outside damaging force, further aided by guard blocks mounted to the side edge of the base member. As a knife blade is pushed down through the slot, it engages the sharpening steels at this intersection point and pushes the steels inwardly, sharpening the opposing cutting edges of the knife blade simultaneously as the knife blade is swiped along the sharpening steels. A pivotably-mounted wiper wing under the influence of its own counterweight polishes the sharpened blade. A pair of cams that are eccentrically mounted to the base member act to arrest the lateral movement of the steels during the knife sharpening operation, as well as to define the downward resting point of the counterweights when the sharpening steels are in their standby position when the knife blade is disengaged. However, these cams must be carefully adjusted in their eccentric positions along the base member prior to the knife sharpening operation to define how high or low the crossed intersection point of the steels will be situated over the slot. A higher position requires greater force applied to the knife blade during the sharpening operation resulting in this higher intersection point of the steels producing a less-sharp cutting angle along the knife blade. A lower intersection position on the other hand requires less force applied to the knife blade during the sharpening operation resulting in a sharper cutting angle produced by the steels along the knife blade. Thus, the MOUSETRAP STEEL sharpener requires the user to know in advance the angle of the cutting edges that must be produced along the sharpened knife blade, and to precisely adjust in advance the cams' positions to achieve this desired angle. This requires skill and patience by the user. Yet over time, the significant weight of the heavy, 20-ounce counterweights will cause the cams to move from their intended position, thereby making repeated sharpening of knives with the same cutting edge angle impossible without further precise adjustment of the position of the cams. Furthermore, the large number of parts mounted to the base member and the bolts and nuts used to mount them also produce environments for bacterial growth which makes it difficult to keep the device clean and sanitary.

U.S. Pat. No. 4,934,110 issued to Juranitch back in 1990 discloses an edge sharpening apparatus having a panel with a slot and two pivotably curved sharpening steels attached to counterweights similar to U.S. Pat. No. 5,655,959. It also discloses, however, another embodiment in which the counterweights are replaced by coil springs that are connected between the pivotable plates attached to the sharpening steels and the panel member of the sharpening device. These coil springs act to pull the pivotable plates to impede the sharpening steels from pivoting under the force of the knife blade that is being sharpened. However, it was found in actual practice that these coil springs failed to provide enough tension and counterforce on the sharpening steels to allow them to provide sufficient pressure against the knife blade to sharpen its cutting edges. Moreover, the coil springs had a tendency to become separated from the knife sharpener device during operation, and contaminate meat that was being processed on an industrial line, or damage surrounding equipment like grinders or conveyor belts. For these reasons, this product design with coil springs failed in the commercial field, and springs were abandoned in favor of counterweights.

U.S. Pat. No. 9,545,703 recently granted to Juranitch discloses a small, light-weight, and portable apparatus for the sharpening of the blade of a knife and maintaining the sharpened blade edge comprising a panel member having an elongated slot extending therein. A pair of attachment tabs is used to secure a pair of sharpening steels to the panel member along pivot points on opposite points of the slot without counterweights. The sharpening steels have an upper attachment end, a curved upper segment extending downwardly from the upper attachment end, and a straight lower end segment extending downwardly from the curved upper segment. The sharpening steels swing downwardly in crossed relation about their pivot points along the slot in a plane adjacent and parallel to the plane of the panel member, the crossed relation defining an intersection point.

A pair of cams mounted to the front face of the panel member having a vertical slot therein. A pair of leaf springs is attached to the vertical slots in the cams. They have a bearing surface for abutting one of the sharpening steels to bias it into its standby position. The cams are preferably mounted to the panel member in a stationary manner to prevent movement of the leaf springs out of proper alignment with the sharpening steels during the knife sharpening operation.

When the knife blade is pushed downwardly in the slot of the panel member of the knife sharpener, it comes into contact with the intersection point of the crossed sharpening steels, the intersection point being moved lower along the slot, bowing the sharpening steels under tension against the bearing surfaces of the leaf springs. As the knife blade is drawn downwardly, outwardly, and through the slot, its cutting edges are sharpened by their engagement with the sharpening steels. The angle of the intersection point of the crossed sharpening steels should ideally be about 70 degrees. It has been found that such an angle permits the knife sharpener to automatically sharpen the cutting edges of the knife blade without the user having to know in advance the desired angle of the cutting edges, or match the knife's cutting edges with the surface of the sharpening steels. Thus, the knife blade can be readily sharpened with minimal skill or training by the user.

The knife sharpener can also include a wiper rod pivotably mounted to the panel member that overlays the panel board slot. When the knife blade is moved down the slot to be sharpened by the sharpening steels, it also engages the wiper rod to further polish the sharpened cutting edges of the knife. A counterweight is used to place the wiper rod under tension and impede the force applied by the knife blade against the wiper rod. However, this counterweight is considerably lighter than the counterweights used in prior art knife sharpeners.

However, the panels of these prior art knife sharpener devices are typically made from a plastic material that will not damage the cutting edges of the knife blade by the slot edges as the blade is drawn through the slot to engage the sharpening steels and wiper rod to sharpen and polish the cutting edges. But plastic material can become nicked or gouged over time. Such nicks or gouges can provide ready sites for bacterial growth that contaminate the knife blade as it is sharpened. A metal material like stainless steel is tougher than plastic and less prone to nicking, gouging, or scratching. However, if the metal material is substituted for the plastic material used for the panel board to make the knife sharpener "food safe," the metal edges adjacent to the slot may deform the knife blade cutting edges as the knife blade is drawn through the slot to be sharpened and polished along the sharpening steels and wiper rod.

Therefore, it would be very advantageous to provide a sharpening apparatus that may be used by a relatively unskilled person to simultaneously sharpen the two opposed cutting edges of a knife blade by hand and to maintain a sharpened cutting edge along the blade with minimal effort and training. Such an apparatus should be mounted in a stationary location where working space is limited and tight. Moreover, the device should enable the sharpening of the blade's cutting edges without having to maintain a specific swiping angle, or precisely adjust the position of cams to enable the sharpening steels to produce the desired cutting edge angle along the knife blade. Furthermore, the sharpening device should feature a panel having a slot made from a food-safe metal material like stainless steel, yet equip the slot edges of the panel with their own protection and sharpening means to prevent damage to the knife blade cutting edges as the blade is drawn through the slot to sharpen them along associated secondary steeling rods, and guide the knife blade in proper orientation through the slot. Such a sharpening apparatus can be used to maintain an extremely sharp cutting edge for precise cutting of a material without crushing or other damage with significantly reduced physical force and strain upon the user.

SUMMARY OF THE INVENTION

An apparatus for the sharpening of the blade of a knife and maintaining the sharpened blade edge is provided according to the invention. The knife sharpener comprises a panel member having an elongated slot extending therein with secondary steeling rods attached to at least one of the edges of the slot.

A pair of counterweights is used to secure a pair of sharpening steels to the panel member along pivot points on opposite points of the slot. The sharpening steels having an upper attachment end, a curved upper segment extending downwardly from the upper attachment end, and a straight lower end segment extending downwardly from the curved upper segment. The sharpening steels swing downwardly in crossed relation about their pivot points along the slot in a plane adjacent and parallel to the plane of the panel member, the crossed relation defining an intersection point.

When the knife blade is pushed downwardly in the slot of the panel member of the knife sharpener, it comes into contact with the intersection point of the crossed sharpening steels, the intersection point being moved lower along the slot, bowing the sharpening steels under tension against the bearing surfaces of the leaf springs. As the knife blade is drawn downwardly, outwardly, and through the slot, its cutting edges are sharpened by their engagement with the sharpening steels. The angle of the intersection point of the crossed sharpening steels should be about 60-70 degrees, ideally 70 degrees. It has been found that such an angle permits the knife sharpener to automatically sharpen the cutting edges of the knife blade without the user having to know in advance the desired angle of the cutting edges, or match the knife's cutting edges with the surface of the sharpening steels. Thus, the knife blade can be readily sharpened with minimal skill or training by the user.

The secondary steeling rods attached to the edges of the slot in the panel member act to guide the knife blade as it is pushed downwardly in the slot to ensure proper orientation with respect to the sharpening steels, and to protect the knife blade from coming into contact with the edges of the slot in the panel member that might otherwise dull or damage the cutting edge of the knife blade. Additionally, should the knife blade come into contact with the secondary steeling rods while being pushed or drawn through the slot, the secondary steeling rods can act to sharpen or repair any damage that has occurred to the cutting edges of the knife blade.

The knife sharpener can also include a wiper rod pivotably mounted to the panel member that overlays the panel board slot. When the knife blade is moved down the slot to be sharpened by the sharpening steels, it also engages the wiper rod to further polish the sharpened cutting edges of the knife. A counterweight is used to place the wiper rod under tension and impede the force applied by the knife blade against the wiper rod. However, this counterweight is considerably lighter than the counterweights.

In an alternate embodiment of the knife sharpener of the present invention, a pair of attachment tabs is used to secure a pair of sharpening steels to the panel member along pivot points on opposite points of the slot instead of the counterweights. A pair of cams mounted to the front face of the panel member having a vertical slot therein. A pair of leaf springs is attached to the vertical slots in the cams. They have a bearing surface for abutting one of the sharpening steels to bias it into its standby position. The cams are preferably mounted to the panel member in a stationary manner to prevent movement of the leaf springs out of proper alignment with the sharpening steels during the knife sharpening operation.

The knife sharpener device of the present invention may be conveniently located on a bench top or other work surface along a meat processing line or any other location where knives are used. It can also be easily used in tight quarters where space is limited. The panel member of the knife sharpener is preferably made from stainless steel which can be readily cleaned to prevent breeding grounds for bacteria.

DETAILED DESCRIPTION OF THE PREFERRED EMBODIMENT

Figure 1:
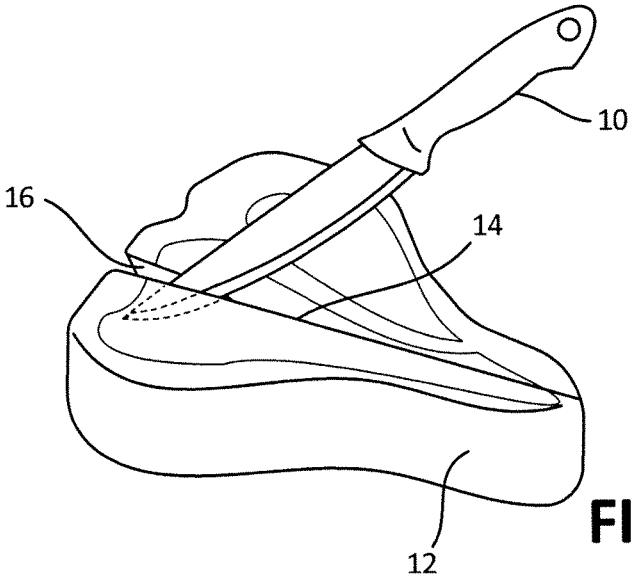
FIG. 1 is a perspective view of a knife cutting a material like a piece of meat.

A sharpening apparatus that may be used by a relatively unskilled person to simultaneously sharpen the two opposed cutting edges of a knife blade by hand and to maintain a sharpened cutting edge along the blade with minimal effort and training is provided by the invention. The apparatus comprises a panel member made from a metal material like stainless steel with a slot partially extending from its top edge. A pair of sharpening steels are pivotably mounted to the panel member, and they swing downwards in a crossed relation across the slot. A pair of counter-weights attached to the top ends of the sharpening steels bias the sharpening steels in their standby position. When the knife blade is moved down through the slot, it comes into contact with crossed sharpening steels to bow them outwards under tension applied by the counterweights. The cutting edges of the knife blade are drawn along and against the sharpening steels to automatically sharpen their cutting edges at the proper angle without any need to match angles between the cutting edges of the knife and the sharpening steels. A wiper rod biased by a separate counterweight can polish the sharpened cutting edges. A secondary steeling rod is attached to at least one edge of the slot. Thus, as the knife blade is moved down and through the slot to guide the blade in proper orientation with respect to the criss-crossed sharpening steels, the one or more secondary steeling rods attached adjacent to the slot edges protect the blade edges of the knife from deformation or other damage caused by the slot edges as the blade is drawn through the slot, and act to realign any deformations along the cutting edge to sharpen the blade. Such a sharpening apparatus can be used to maintain an extremely sharp cutting edge for precise cutting of a material without crushing or other damage with significantly reduced physical force and strain upon the user.

For purposes of the present invention, "cut substrate" means a material such as paper, cardboard, metal foil, thin plastic, textiles, cloth, silk, rope, twine, wire, wood veneers, wood, construction materials, flowers, tree or plant part, or foods like meats that is capable of being cut or trimmed by a knife.

As used within this Application, "knife" means a hand-operated cutting tool with a cutting edge or blade and a handle for cutting or trimming a cut substrate. It can have a fixed blade or a blade that folds or slides into a slot in the handle. It includes, without limitation, except for serrated edges, knives used as dining utensils or in food preparation like a bread knife, boning knife, carving knife, chefs knife, cleaver, butcher's knife, electric knife, kitchen knife, oyster knife, paring or coring knife, rocker knife, steak knife, table knife, or ulu; knives used as tools like a Bowie knife, cobbler's or shoemaker's knife, crooked knife, wood carving knife, diver's knife, electrician's knife, hunting knife, linoleum knife, machete, palette knife, paper knife or letter opener, pocket knife, produce knife, rigging knife, scalpel, straight razor, survival knife, switchblade, utility knife, whittling knife, x-acto knife, balisong, or kiridashi; knives used as weapons like a ballistic knife, bayonet, combat knife, dagger, fighting knife, ramuri, shiv, trench knife, butterfly knife, or throwing knife; or knives used in religious ceremonies like an athame, kirpen, kilaya, kris, kukri, puukko, seax, or sgiandubh.

FIG. 1 shows a knife 10 cutting a cut substrate in the form of a piece of meat 12 along an intended cut line 14. The produced cut line 16 is shown behind the travel path of the knife.

Figure 2:
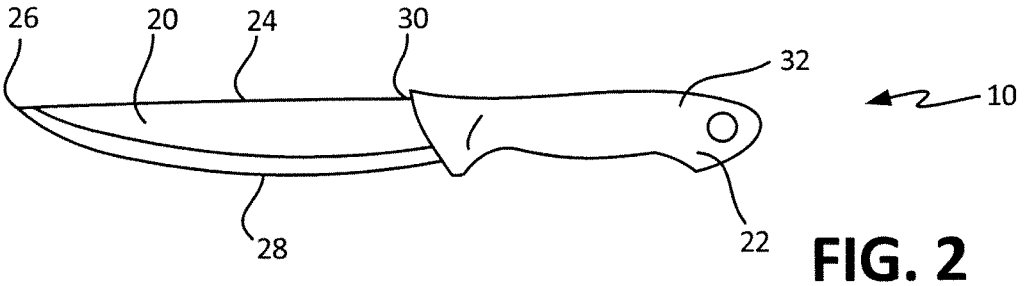
FIG. 2 is a perspective view of a knife.

The knife 10 is a hand-operated cutting tool that is shown more clearly in FIG. 2. It consists of a blade 20 and a handle 22. The blade 20 comprises a spine 24 constituting the thickest section of the blade, a point 26 located at the end of the blade, and a cutting edge 28 extending along the bottom surface of the blade from the point 26 to the heel 30. The hilt or butt 32 is formed by the end of the handle 22. The handle 22 used to grip or manipulate the blade 20 safely may include a tang constituting a portion of the blade opposite the point 26 that extends into the handle.

Figure 3:
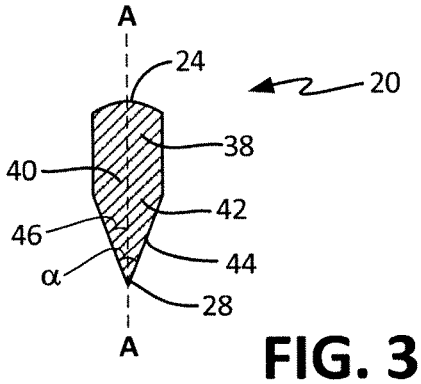
FIG. 3 is a cross-sectional view of the knife blade.

For purposes of the knife sharpener of this invention, the blade 20 should feature a plain edge, or a plain edge portion on a combination knife additionally featuring a serrated blade portion. The knife sharpener of the present invention sharpens and maintains the plain cutting edge of the knife. As shown more clearly in FIG. 3, the blade features a broad middle region 38 with the spine 24 along its top surface. The lower region 40 of the blade features a grind region 42 having a beveled edge 44 produced on one or both exterior surfaces at an edge angle 46 with respect to vertical axis A-A. This beveled edge 44 produces cutting edge 28 running along the bottom surface of the knife blade 12.

The knife blade 20 can be manufactured from a variety of different materials. Carbon steel constituting an alloy of iron and carbon can provide a very sharp cutting edge 28. It holds its edge well and is relatively easy to sharpen, but is also vulnerable to rust and stains. On the other hand, stainless steel constituting an alloy of iron, chromium, possibly nickel, and molybdenum with only a small amount of carbon will not accept quite as long lasting of a cutting edge 28 as carbon steel, but it remains highly resistant to corrosion. High-carbon stainless steel alloys contain a higher amount of carbon, and do not discolor or stain, while maintaining a sharper cutting edge. Titanium metal is characterized by a better strength-to-weight ratio. It is therefore more wear resistant and more flexible than steel. Titanium metal is often heat-treated to produce the necessary hardness required for a longer-lasting cutting edge 28 for the knife blade.

The total included angle α of the knife blade 20 extends from one side of the blade to the other side. Thus, it is double the edge angle 46 for a double-ground knife blade. Unfortunately, this included angle varies widely between different types of knives or cutting apparati. This included angle α is about 20 degrees for razors, pairing knives, and fillet knives that constitute some of the sharpest of cutting blades. Most kitchen knives like utility/slicing knives, chef's knives, boning knives, and carving knives should have an included angle of about 30-50 degrees. Japanese-style knives feature a sharper cutting edge 28 defined by an included angle of about 28-32 degrees. Sporting knives like pocket knives, survival knives, and hunting knives usually feature an included angle of about 50-60 degrees. This shallower angle produces a broader lower region 42 having more metal material on the knife blade which produces a more durable cutting edge 28 for use in the field. Machetes, chisels, draw knives, and axes are typically sharpened to an included angle of about 60-80 degrees for even greater durability. This varying included angle makes it difficult to sharpen the cutting edges of a particular knife by prior art sharpening devices where the desired angle must be known and the device adjusted to produce that angle.

Figure 4:
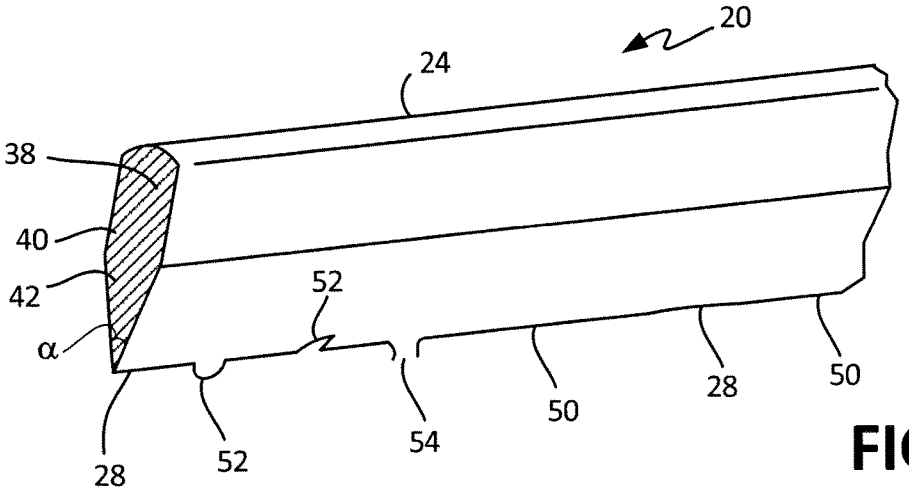
FIG. 4 is a partial perspective view of the knife blade with deformed edges and burrs along its blade.
Figure 5:
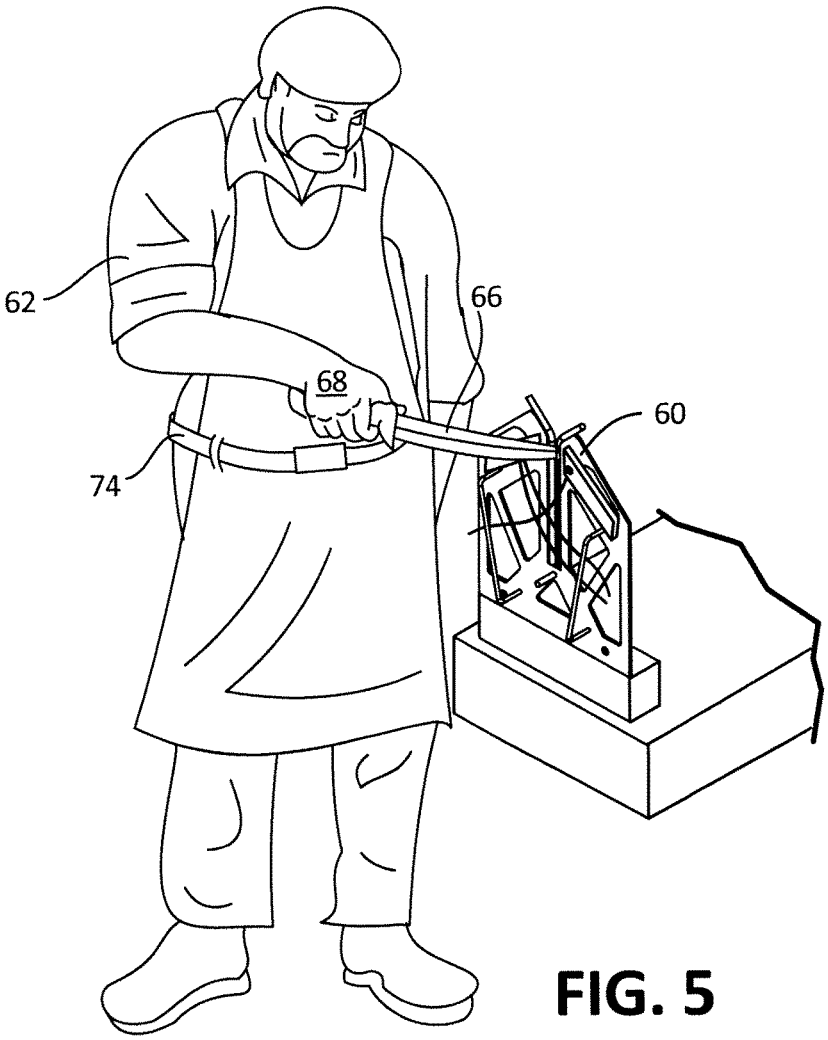
FIG. 5 is a perspective view of the knife sharpener device mounted on top of a work station, and a knife held by a user with the user and knife shown in phantom lines.

But, cutting edge 28 along the bottom surface of the knife blade does need to be maintained in a sharpened state that accommodates its designated included angle. As shown more clearly in FIG. 4, this cutting edge should be maintained in a state with a continuous, straight edge 50 along the length of the blade. But through usage, especially if the knife 10 is used to cut or slide hard objects like bone, ice, or construction materials, portions of this cutting edge 28 may become deformed. Such deformations within the cutting edge may create an outwardly deflected region 52 towards either side of the blade 20. Such deformations cause a "dulled edge" along the knife blade that produces a poor cut by the knife 10. Even more critically, a deformed region 52 may become worse in its deflection over time to the point that its metal separates from the knife blade 20 to form a burr 54 along the cutting edge 28. Such outwardly deflected deformations 52 or burrs 54 will require significantly greater force exerted by the user upon the knife blade 20 to cut or slice, pulling or crushing a cut substrate being cut, and thereby fail to produce a neat and uniform cut. If the knife is used to cut the stem of a flower or plant, these deformations and burrs can crush the edge of the stem to make the flower or plant susceptible to disease or shorten its life.

While a piece of meat 12 has been shown as the piece of cut material cut by the knife 10 for the sake of illustration, a number of other types of cut materials that can be cut or sliced by a knife like skin, plastic, textiles, paper, film, and hobby or construction materials are possible, and should be understood as being fully covered by the scope of this invention.

Figure 6:
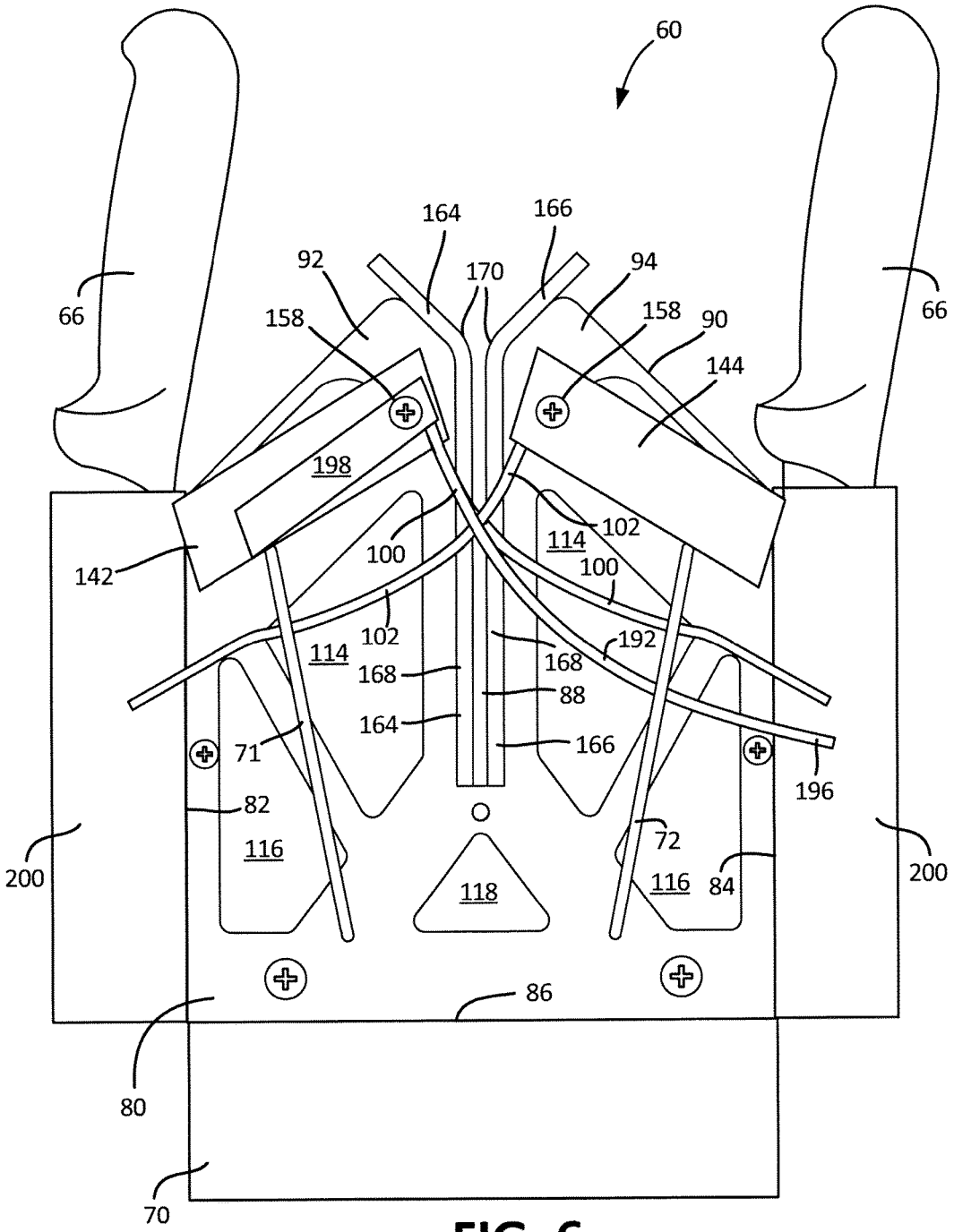
FIG. 6 is a front elevation view of a first embodiment of the knife sharpener device of the present invention.
Figure 7:
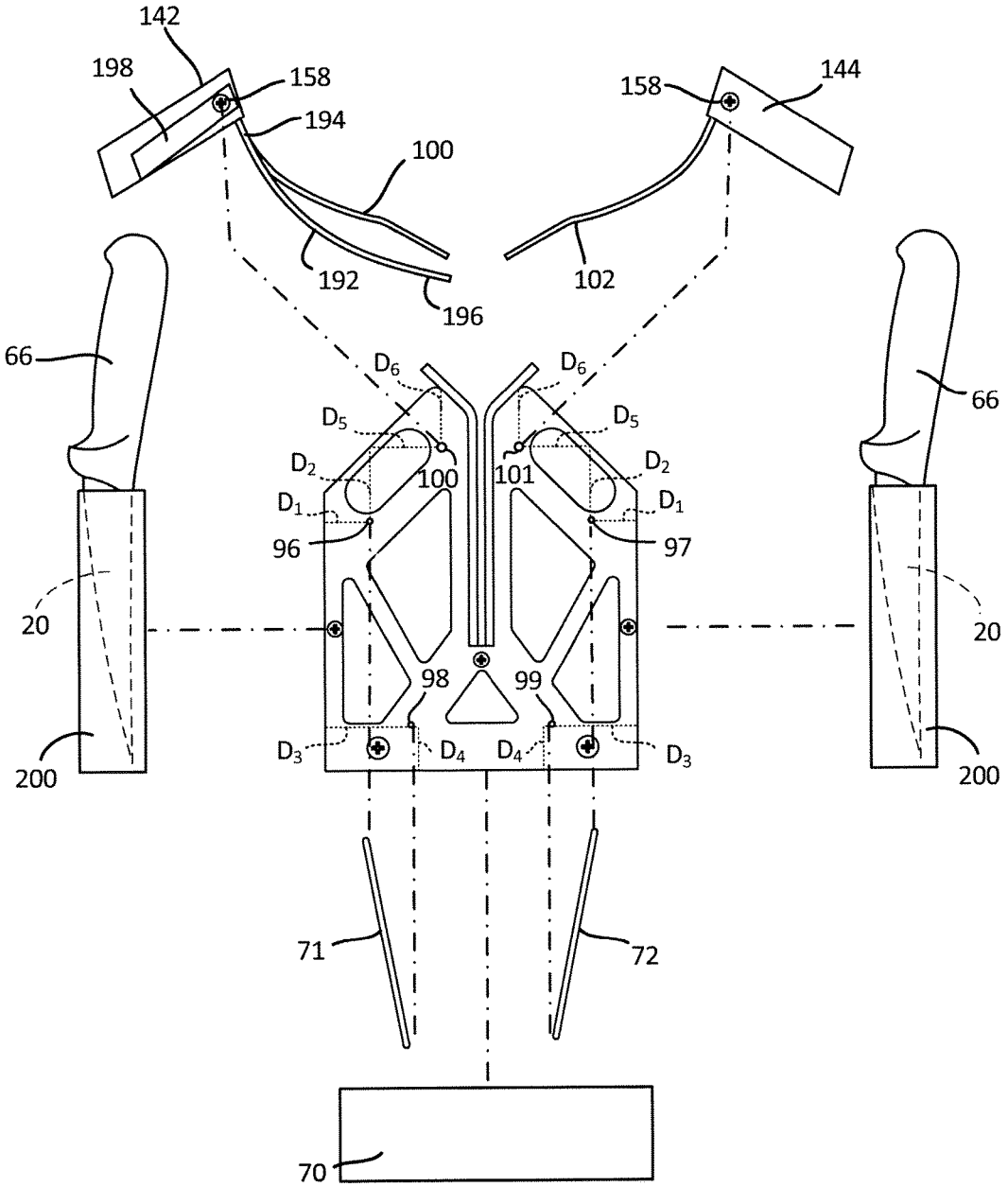
FIG. 7 is an exploded view of the panel member, base, protective wings, counterweights, sharpening steels, and knife receptacles of the knife sharpener of FIG. 6.
Figure 8:
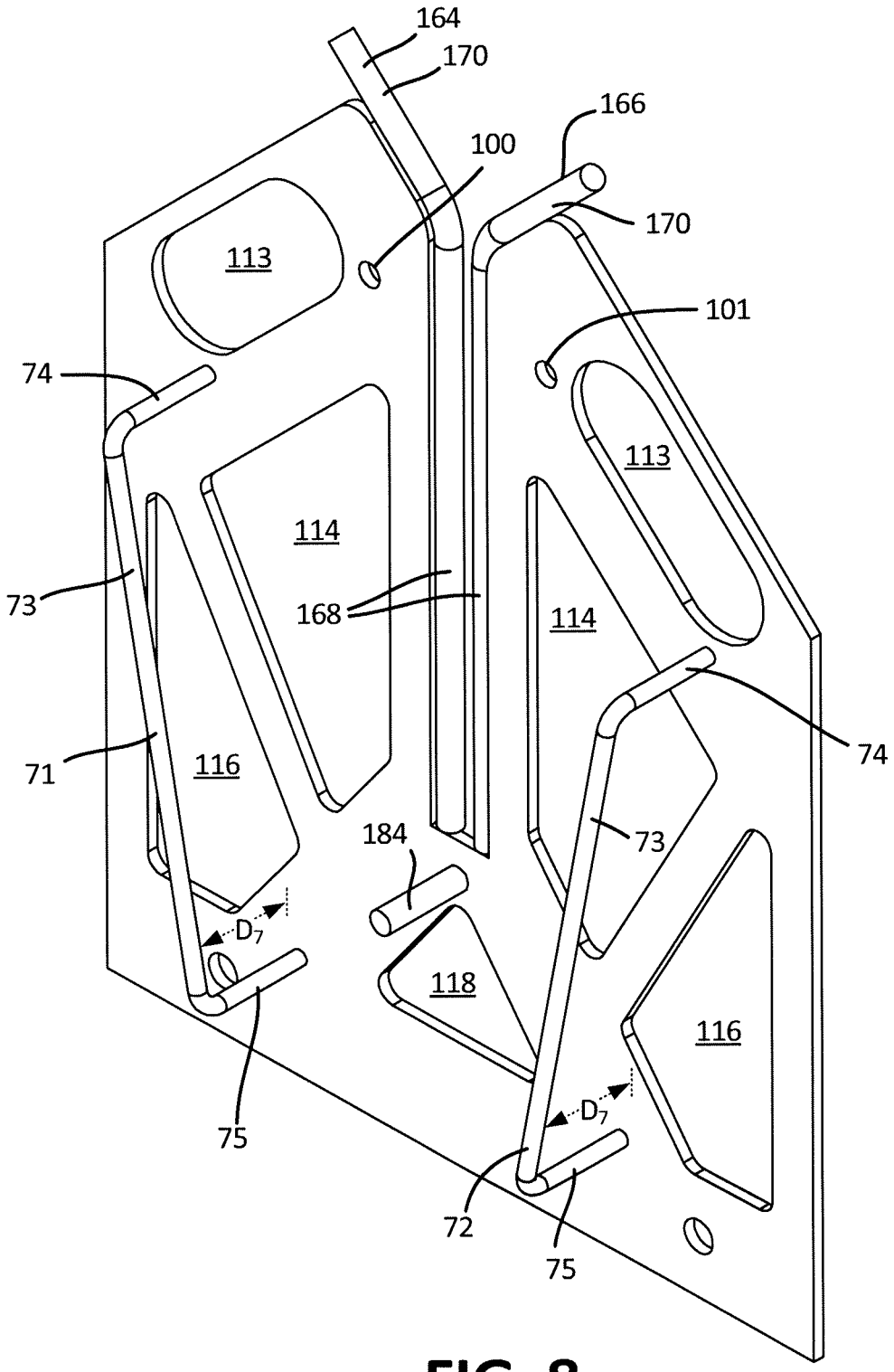
FIG. 8 is a perspective view of the panel member with the secondary steeling rods and protective wings attached.

The knife sharpener 60 is shown more clearly in FIGS. 6-10. As seen in FIG. 6, it comprises a panel member 80 to which is attached a base 70 for mounting the knife sharpener 60 to a suitable surface along a meat processing line such as a bench top or counter. The panel can be made from a hardened plastic or metal material that will withstand knife cuts without undue damage, and is approved by industry standards such as the United States Department of Agriculture for the meat industry. The material should also be readily washable and subject to sterilization since, depending upon the environment in which the knife 66 is used, it may transfer dirt, grime, debris, food material, construction material, bacteria, etc. from the knife 66 to the knife sharpener 60. While other metals like aluminum are possible, the preferred metal material for the panel member 80 is food-grade stainless steel. Even more preferably, it should constitute non-carbon stainless steel such as 303/304 grade stainless steel to avoid potential rust caused by moisture, chemicals, or water that come into contact with the panel member.

At the same time, metal materials, including aluminum and stainless steel, are subject to abrasion that can blunt, chip, gouge, or otherwise damage the knife blade during the sharpening operation. Hence, an important feature of the knife sharpener 60 are the secondary steeling rods 164 and 166 located along either edge of slot 88 in the panel member 80 that will be disclosed more fully below.

As shown more clearly in FIG. 6, the panel member 80 comprises a left edge 82, right edge 84, and bottom edge 86. A slot 88 is formed in the panel to partially bisect it from the top edge 90. This slot should be sufficiently wide to accommodate the width of the knife blade without jamming the knife or otherwise impeding its downward travel along slot 88 during the sharpening operation. Slot 88 bisects top edge 90 of panel member 80 to define upper left region 92 and upper right region 94 on the panel member.

Base 70 extends laterally from bottom edge 86 of panel member 80 to provide a means of resting knife sharpener 60 upon a flat surface like a benchtop or counter. Base 70 may have a plurality of holes 96 (not shown) for accommodating bolts used to secure base 70 and the associated knife sharpener 60 to the bench top or counter.

Located on the upper portion of the panel member 80 near the left edge 82 and right edge 84 are a pair of niches 96 and 97 that may adopt any suitable cross-sectional shape, such as a circle, square, or rectangle. These niches extend only partially through the width of the panel member 80 and feature a flat surface. The niches 96 and 97 should be positioned the same distance $D_1$ from the edge of the panel member 80 and the same distance $D_2$ from the top edge 90 of the panel member.

Similar niches 98 and 99 are located on the lower portion of the panel member 80 further away from the left edge 82 and right edge 84. These niches also extend only partially through the width of the panel member 80, and also feature a flat surface. These niches 98 and 98 should be positioned the same distance $D_3$ from the edge of the panel member, and the same distance $D_4$ from the bottom edge 86 of the panel member.

Also located on the upper left region 92 and upper right region 94 of the panel member 80 are a pair of through holes 100 and 101, respectively. These through holes 100 and 101 should be positioned the same distance $D_5$ from the edge of the panel member 80, and the same distance $D_6$ from the top edge 90 of the panel member.

A pair of guard wires 70 and 72 are U-shaped, featuring an elongated central portion 73 and side legs 74 and 75 extending from the central portion at an angle of about 90°. The guard wires 70 and 72 may bear any suitable cross-sectional shape 76 such as a circle, square, or rectangle. This cross-sectional shape 76 should match the cross sectional shape of niches 96, 97, 98 and 99. Ideally, it should be slightly larger than the cross-sectional shapes of the corresponding niches. In this manner, the side legs 74 and 75 of guard wires 70 and 72 can be press fit into the niches 96 and 97 and 98 and 99, respectively, so that the guard wires are attached to the panel member 80. Central portion 73 of the guard wires should be approximately parallel to the front surface of the panel member, and located distance $D_7$ of about ⅞ inches from the front surface of the panel member.

Alternatively, the side leg 74 and 75 of the guard wires 70 and 72 may be secured to the panel board by means of fasteners inserted through the back side of the panel member. Another securement method may entail welding the metal guardrail legs 74 and 75 to the front surface of the panel board.

A series of apertures 114, 116 and 118 may be formed within panel board 80. The stainless steel material used to make panel board 80 is strong enough to accommodate the loss of material within these apertures 114, 116 and 118. At the same time, a panel board bearing these apertures is lighter in weight and less expensive to manufacture than a solid stainless steel panel board would be.

Pivotally mounted upon the panel member 80 are a pair of counterweights 142 and 144. As shown more clearly in FIGS. 7 and 9, these counterweights 142 and 144 comprise a slab 146 of metal with holes 148 and 150 formed in them. The counterweights 142 and 144 are secured to panel member 80 by means of a bolt extending through the holes 148 and 150 and corresponding holes 99 and 101 formed in the panel member 80. These holes 148 and 150 are positioned distance $D_8$ from the inside edge 154 of the counterweights and distance $D_9$ from the top edge 156 of the counterweights. Counterweights 142 and 144 weigh about 4.5-6.1 ounces, preferably 5.0-5.8 ounces, respectively. They may also have different weights. In a preferred embodiment, the left counterweight 142 may weigh about 5.2 ounces, while the right counterweight weighs about 5.6 ounces.

A threaded insert (not shown) is fitted inside left through hole 99 and right through hole 101 in panel member 80. Bolts 158 having a threaded shank extend through holes 148 and 150 located in the counterweights 142 and 144, respectively, and into threaded engagement with the threaded inserts of the through holes to pivotally mount the counterweights to the panel member. These bolts 158 define the rotational axes for the counterweights.

Figure 9:
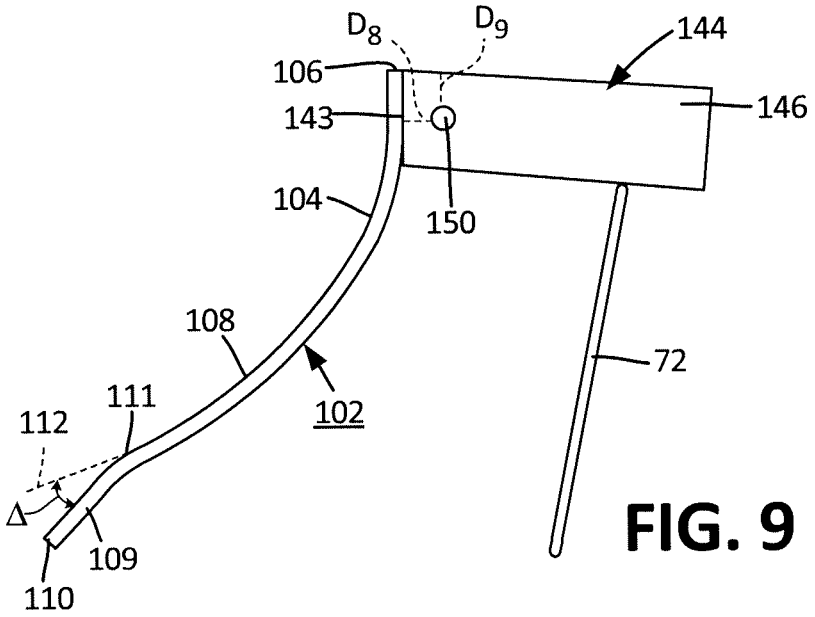
FIG. 9 is a frontal view of the counterweight and right-hand sharpening steel.
Figure 10:
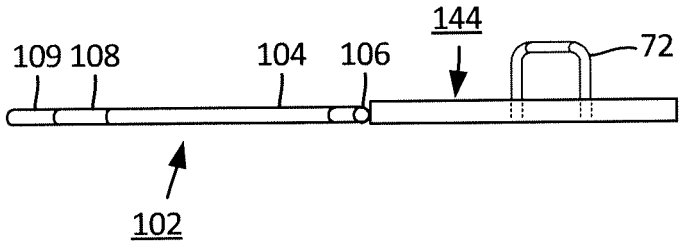
FIG. 10 is a top plan view of the counterweight and sharpening steel of FIG. 9.
Figure 11:
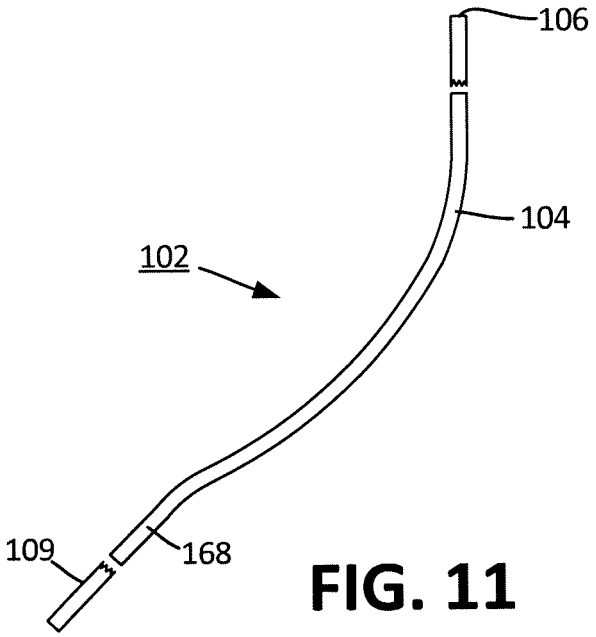
FIG. 11 is a deconstructed view of the sharpening steel.
Figure 12:
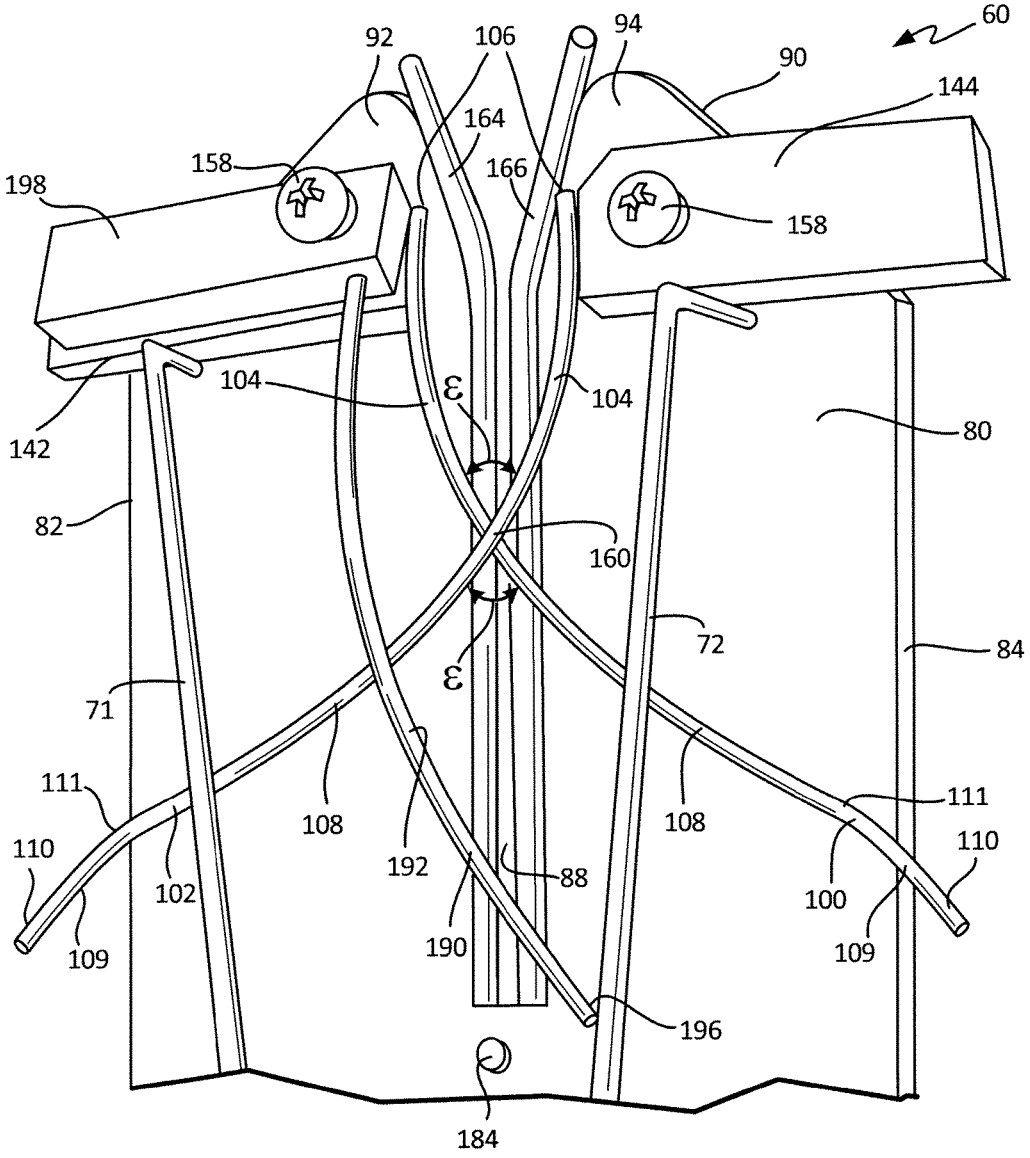
FIG. 12 is a partial front elevation view of a portion of the knife sharpener of FIG. 6.
Figure 13:
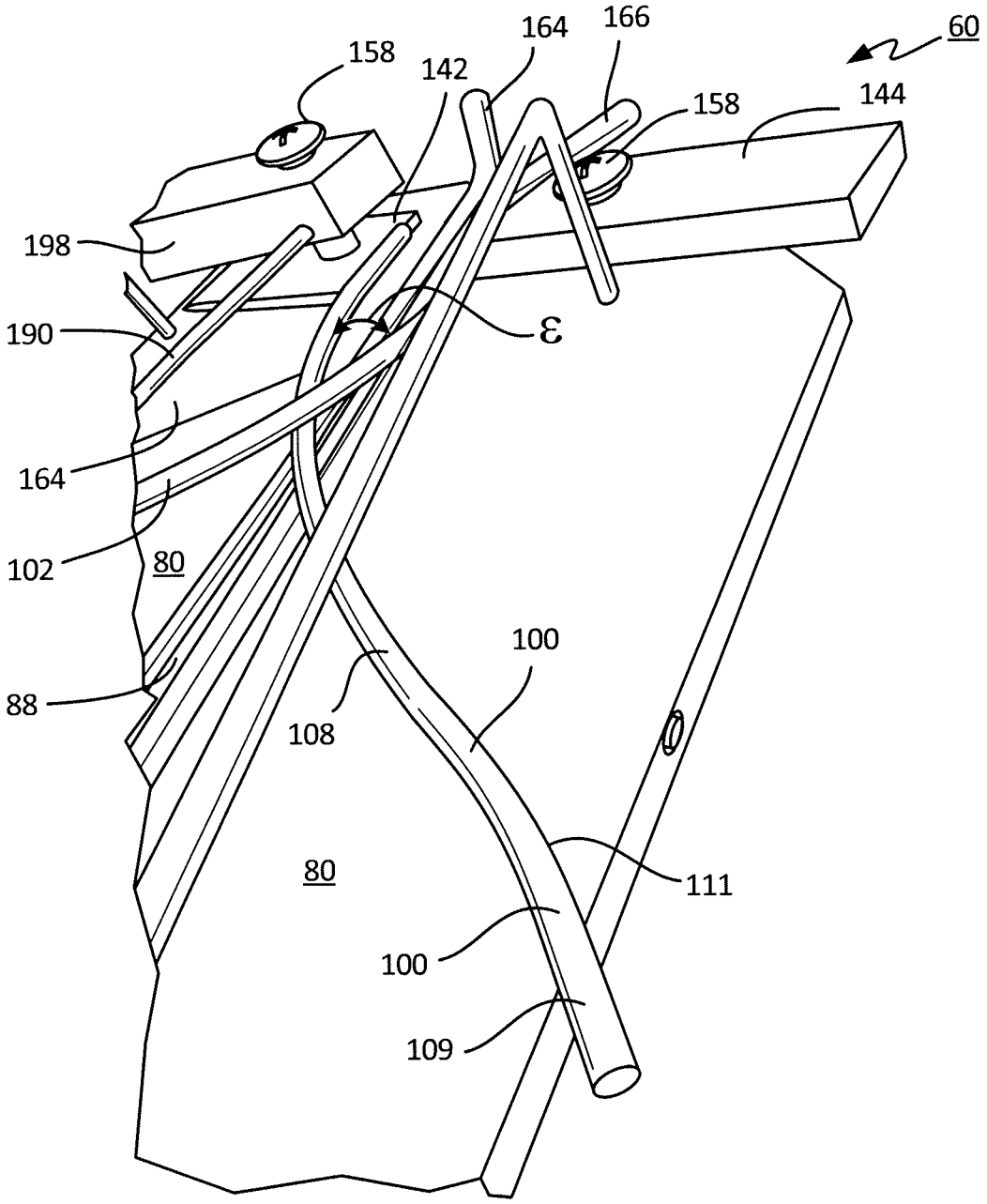
FIG. 13 is a partial perspective view of a portion of the knife sharpener of FIG. 6.

A pair of sharpening steels 100 and 102 are fixedly connected along their attachment ends 106 to the inside edges 143 of counterweights 142 and 144, respectively. As shown in FIGS. 6 and 9, the left-hand sharpening steel 100 and right-hand sharpening steel 102 overlay panel member 80. These two sharpening steels each have a roughly circular cross section, although other shapes like an oval or triangle may be used. The sharpening steels 100 and 102 extend toward each other in criss-crossed relation, intersecting at point 160 along slot 88.

The sharpening steels 100 and 102 represent a honing steel, sometimes referred to as a "sharpening steel," "sharpening rod," "sharpening stick," or (in the food or cooking industry) a "butcher's steel" or "chef's steel." They comprise a rod made from hardened steel, stainless steel or stainless steel alloy, diamond-coated steel, or ceramic. When made from a carbon-containing stainless steel material like 440 C alloys (sourced, for example, from Discount Steel of Minneapolis, Minn.) or ceramic, they bear a smoothly, highly polished exterior surface. Optionally, they may include a plurality of longitudinal ridges. When made from diamond-coated steels, the steel material is embedded with abrasive diamond particles. Suitable diamond-coated steel or ceramic materials may be sourced from the Norton affiliate of Saint-Gobain Corporation of Courbevoie, France. But, the material from which the sharpening steels 100 and 102 are fabricated must have a higher tensile strength than the metal from which the knife blade 20 is made, or else it must be treated to a surface hardening process.

As is shown in FIGS. 6 and 9-11, each of the sharpening steels 100 and 102 has a terminal segment 109 that is relatively straight as compared with the concave segment 104, and extends away from the upward curvature of the concavely-shaped segment 104. The terminal segment 109 is convexly curved downwardly slightly beyond a straight orientation, and is connected to the upper concave segment 104 by a slightly more convex intermediate segment 108. As a consequence, the concavity of the upper segment 104 terminates at the intermediate segment 108, and the terminal segment 109 extends at an angle A to the tangent 112 line at its point of termination of concavity. This point of termination of concavity is at the point where intermediate segment 108 joins upper segment 104. Bend point 111 on the sharpening steel is defined by this transition from intermediate segment 108 to terminal segment 109. The angle A should be about 36-70 degrees preferably about 40-55 degrees, most preferably about 48 degrees. The upper segment 104 is fixedly secured to the inside edge 143 of the counterweights 142, 144, such as by a weld.

Once counterweights 142 and 144 are secured to panel member 80 as described above, the arced upper segment 104 of the sharpening steels 100, 102 curves along and above the top surface of panel member 80, passing over slot 88. Meanwhile, straight intermediate segment 108 of sharpening steel 100, 102 passes along and above the top surface of panel member 80 below guard wires 70 and 72 and side legs 74 to protect the sharpening steels from being torn off the panel member by an external force. Distal end 110 of the sharpening steel 100, 102 extends beyond the edges 82 and 84 of panel member 80. As shown in FIG. 6, sharpening steel 102 is positioned above sharpening steel 100, so that they cross over each other at intersection point 160 over slot 88.

Secured to at least of the edges of slot 88 in panel member 80 are secondary steeling rods 164 and 166. As shown more clearly in FIGS. 6-8, each of the secondary steeling rods comprises a straight section 168 and an angled section 170. The straight section is secured to the length of the slot edge, while the angled section 170 is secured to the similarly angled edge of the top portion of panel member 80 above slot 88. The secondary steeling rods 164 and 166 may have a cross-sectional area of any suitable shape, although a circular cross section is preferred. The diameter of the cross section should be about 3⁄16 inch. The secondary steeling rods 164 and 166 may be made from a 303/304 stainless steel material that is hard enough not to be nicked by the cutting edge of the passing knife blade, while not causing damage to the knife blade. 303/304 stainless steel is preferred. Ryerson Steel of Chicago, Ill., is a suitable source for the secondary steel rods.

The secondary steeling rods 164 and 166 are preferably welded to the slot edges of the panel member 80. By using a non-carbon stainless steel like 303/304 stainless steel for both the panel member and the secondary steeling rods, the weld will not produce rust.

The gap $D_{10}$ within the slot 88 of the panel member between the exterior edge of the secondary steeling rod 166 and the other side of slot, including any secondary steeling rod, is about 0.14-0.25 inch, preferably about 0.156 inch (5⁄32 inch). Such a gap width should balance the competing interests of a sufficiently small gap width to guide the knife blade through the slot, while having a sufficiently large gap width to avoid binding of the knife blade against the secondary steeling rod(s) or slot edge, taking into account the typical knife blade widths. This gap width $D_{10}$ could be tailored to a specific knife type and its blade width.

When the sharpening steels 100 and 102 are in their standby position, counterweights 142 and 144 pull the sharpening steels 100 and 102 upwardly towards the top edge 90 of panel with the bottom edge of the counterweights resting on side legs 74 of wings 70 and 72, and with intermediate segments 108, respectively, with a more horizontal position to hold the sharpening steels in a stationary position. As shown in FIG. 14A, the user 62 inserts knife blade 20 into slot 88 of the panel member 80 from its top edge 90, and pushes the knife blade 20 down through the slot until it meets intersection point 160 of the two sharpening steels 100 and 102. The secondary steeling rods 164 and 166 will act to protect the cutting edges 44 of the knife blade from abutting the edges of the slot 88 which might otherwise damage the cutting edges. At the same time, the secondary steeling rods 164 and 166 act to guide the movement of the knife blade within slot 88 to maintain proper orientation of the knife blade against the sharpening steels 100 and 102.

Figure 14B:
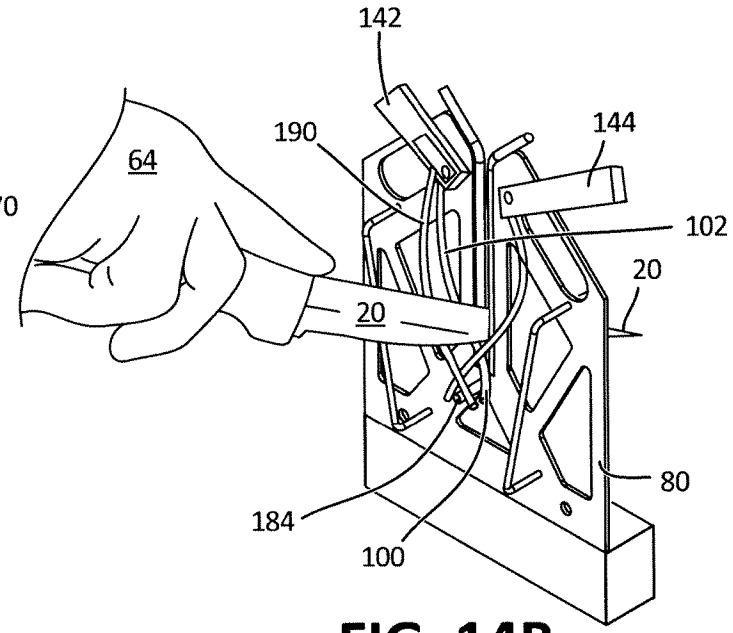
FIG. 14B is a partial perspective view of the knife sharpener of FIG. 14A with the knife blade further progressed along the sharpening steels and wiper rod.
Figure 14A:
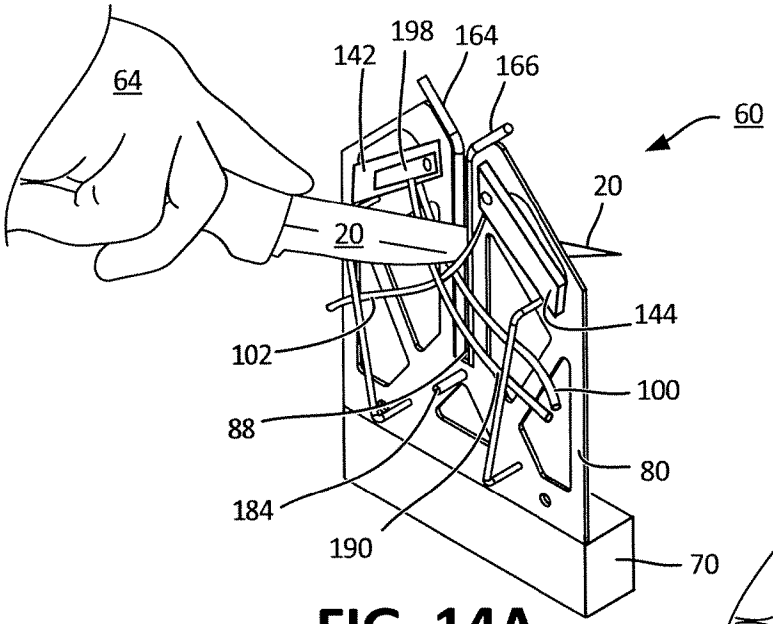
FIG. 14A is a partial perspective view of the knife sharpener of FIG. 6 with the sharpening steels and wiper rod in their standby positions, and the knife blade first engaging the sharpening steels.

Continued application by hand 64 of downwards force upon knife blade 20 causes the intersection point 160 of the sharpening steels 100 and 102 to likewise move in a downwards direction, as shown in FIG. 14B. The upper curved segments 104 of the sharpening steels will bow outwardly, while the terminal segments 109 are drawn towards each other until they or the distal ends 110 of the sharpening steels come into contact with stop post 184 extending from the top surface of panel member 80. At the same time, the user's hand 64 draws the knife blade towards the user so that the beveled edges 44 of the knife blade 20 are slid along the intermediate segments 108 of the sharpening steels 100 and 102. In this matter, deformed edges 52 of the knife blade 20 are realigned to produce a sharpened cutting edge 28. When pressure is applied on the knife blade against the hard sharpening steels, it causes the blade's metal to yield to the harder sharpening steel metal or ceramic material of the sharpening steel to become realigned and thus sharpened. The counterweights 164 and 166 provide impedance against the downwards movement of the sharpening steels 100 and 102 to prolong the contact by the knife blade with the sharpening steels.

The slot 88 of the panel member 80 properly orients the knife blade 20 with respect to the sharpening steels 100 and 102. The counterweights orient the sharpening steels with respect to the slot and knife blade, and keep proper tension on the sharpening steels during the sharpening operation.

The angle ε at the intersection point 160 of the criss-crossed sharpening steels should be about 50-80 degrees, preferably about 65-75 degrees, most preferably about 70 degrees. Moreover, this intersection angle ε will be roughly maintained throughout the sharpening operation. It has been found that this angle allows the cutting edge of the knife blade to be sharpened at the correct angle for that knife without any need to match angles between the cutting edge and sharpening steels or make adjustments to the sharpening device, as is required by prior art devices. The distances $D_5$ and $D_6$ for the placement of the through holes 99 and 101 in the panel board 80, and the distances $D_8$ and $D_9$ for placement of the holes 146 and 148 in the attachment tabs 142 and 144 should be correctly defined at the point of manufacture to produce this desired intersection angle ε for the sharpening steels 100 and 102 pivotally mounted to the panel member via the attachment tabs.

Yet, the sharpening steel surface must also be super smooth in order to avoid further damage and deformation caused by the sharpening steel to the knife blade that could cause unwanted burrs along the blade edge. Thus, the sharpening steels do not function like grinding wheels, whetstones, or hones that are commonly used to remove metal burrs from a blade before it can be sharpened. At the same time, the two sharpening steels 100 and 102 simultaneously treat the opposite beveled edges 44 of the knife blade to realign the cutting edge 28. Because of the cylindrical surface of the sharpening steels 100 and 102, they sharpen the cutting edge without any need to maintain the knife blade at a specified angle with respect to the sharpening surface unlike with prior art processes. This enables unskilled persons to sharpen knife blades using the knife sharpener device 60 of the present invention.

Optionally attached to knife sharpener 60 is wiper rod 190. Constituting sharpening steel in its own right, it has a gradually curved main body 192 with an attachment end 194 and a distal end 196. The attachment end 194 is secured to a counterweight 198 comprising a slab 200 of metal with a hole 202 in it. Counterweight 198 is secured to panel 80 by means of a bolt extending through the hole 202 and a corresponding hole (not shown) in the panel 80. As shown in FIG. 6, the same bolt 152 may be used to secure both attachment tab 142 and counterweight 198 to panel member 80. Counterweight 198 only weighs about 2 ounces. This is much lighter than the counterweights 163 and 164.

When assembled, the curved body 192 of wiper rod 190 extends from its attached end 194 and counterweight 198 over and above panel member 80 and sharpening steel 102 and slot 88 with its distal end 196 extending adjacent to or past right edge 84 of panel 80 (see FIG. 10A). When the knife blade 20 is pushed downwards through slot 88 to contact the sharpening steels 100 and 102 at intersection point 160 and continued to push the sharpening steels in a downwards direction (see FIG. 15B), the knife blade 20 will contact wiper rod 190 to also push it down. By drawing the knife blade along wiper rod 190 in addition to sharpening steels 100 and 102, the wiper rod 190 will act to polish the sharpened cutting edge 28 produced by the sharpening steels 100 and 102 to further straighten any imperfections along the cutting edge. At the same time, counterweight 198 provides impedance against the downward movement of the wiper rod to prolong the contact by the knife blade with the wiper rod. There is no leaf spring biasing the wiper rod.

When the knife blade is withdrawn from the slot 88 in the knife sharpener 60, the tails 178 of the counterweights 142 and 144 will act to bias sharpening steels 102 and 100, respectively, back to their stand-by position shown in FIG. 14A. Meanwhile, counterweight 198 acts to return wiper rod 190 to its standby position. The knife sharpener 60 is now ready to sharpen the cutting edge along the blade 20 of the same knife 10 or another knife.

Sharpening steels normally cannot repair burrs or other severely deformed regions along a knife blade cutting edge. They just realign less severely deformed regions. However, in the case of the present invention, the sharpening steels 100 and 102 allow such a repair step to be carried out. A bend 111 exists within the sharpening steel 100, 102 where the straight intermediate segment 108 joins the terminal segment 109. This bend provides additional surface area on the sharpening steel. As seen in FIG. 14B, the stop post 184 is properly located on the panel member 80 so that when the terminal segments 109 or distal ends 110 of the sharpening steels abut the stop post to arrest the inward movement of the steels when the knife blade is pressing down on the steels, the intersection point 160 of the criss-crossed sharpening steels is defined by the two bend points 111. When the knife blade 20 is pushed down in the slot 88 to engage this intersection point 160, the stop post 184 will lock the two sharpening steels in place so that further pressure is applied by the bends 111 of the sharpening steels against the burr or severely deformed region of the cutting edge of the knife blade to repair it. The polished exterior of the sharpening steels and locked position of the steels produces this extra sharpening capacity by the knife sharpener 60.

Attached to the sides of panel member 80 of knife sharpener 60 may be at least one storage receptacle 200. The receptacle has a slot 202 formed within its upper portion for accepting a knife blade. In this manner, one or more knives may be stored in receptacles 200, so that either sharpened knives are available for use on the meat processing line, or dulled knives are waiting to be sharpened on knife sharpener 60.

Figure 15:
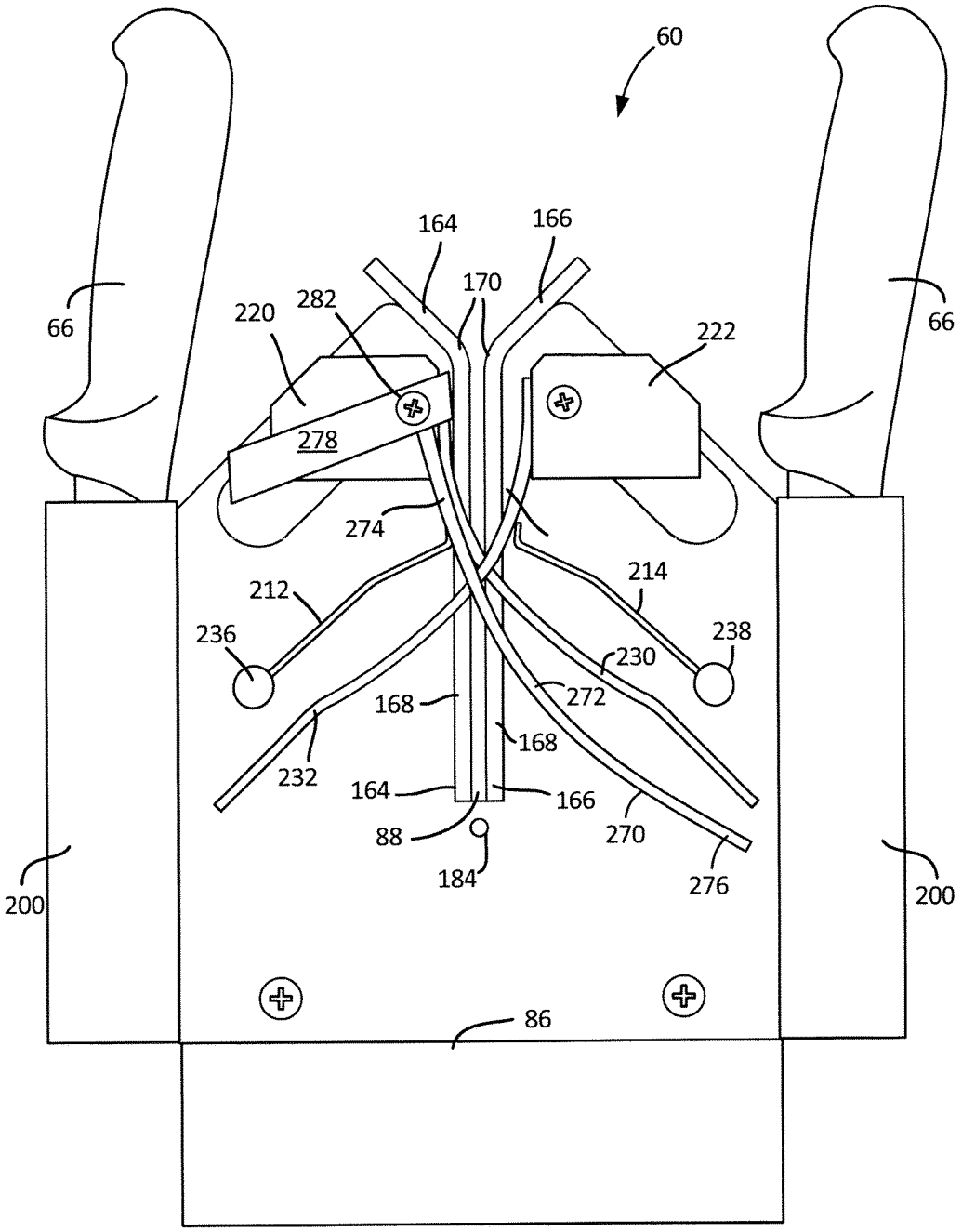
FIG. 15 is a front elevation view of a second embodiment of the knife sharpener device of the present invention.

In an alternative embodiment of the present invention, the counterweights 142 and 144 of sharpening steels 100 and 102 may be replaced by leaf springs 212 and 214, as shown in FIG. 15 for knife sharpening device 210. Parts of the knife sharpener 210 that are similar to the parts of knife sharpener 60 described above are identified in FIGS. 15-19B with the previously used element numbers.

Figure 16:
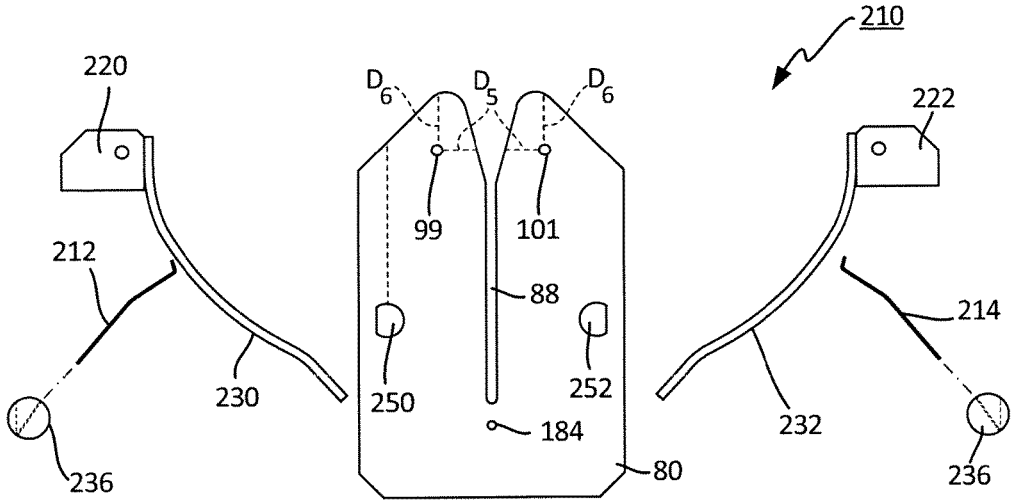
FIG. 16 is an exploded view of the panel member, attachment tabs, sharpening steels, cams, and leaf springs of the knife sharpener of FIG. 15.
Figure 17A:
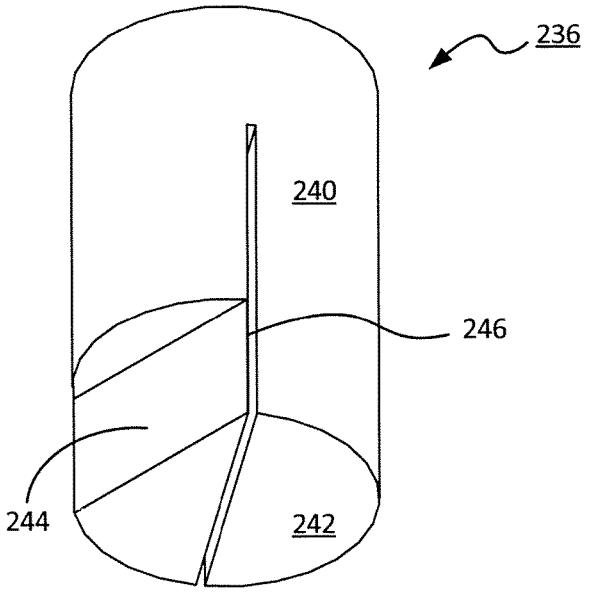
FIG. 17A is a perspective, upwards view of the left-hand stationary cam for the knife sharpener of FIG. 15.
Figure 17B:
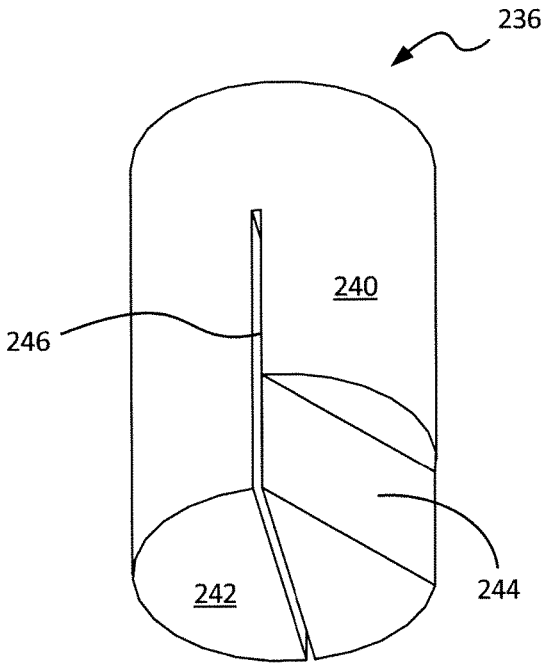
FIG. 17B is a perspective, upwards view of the right-hand stationary cam for the knife sharpener of FIG. 15.
Figure 18:
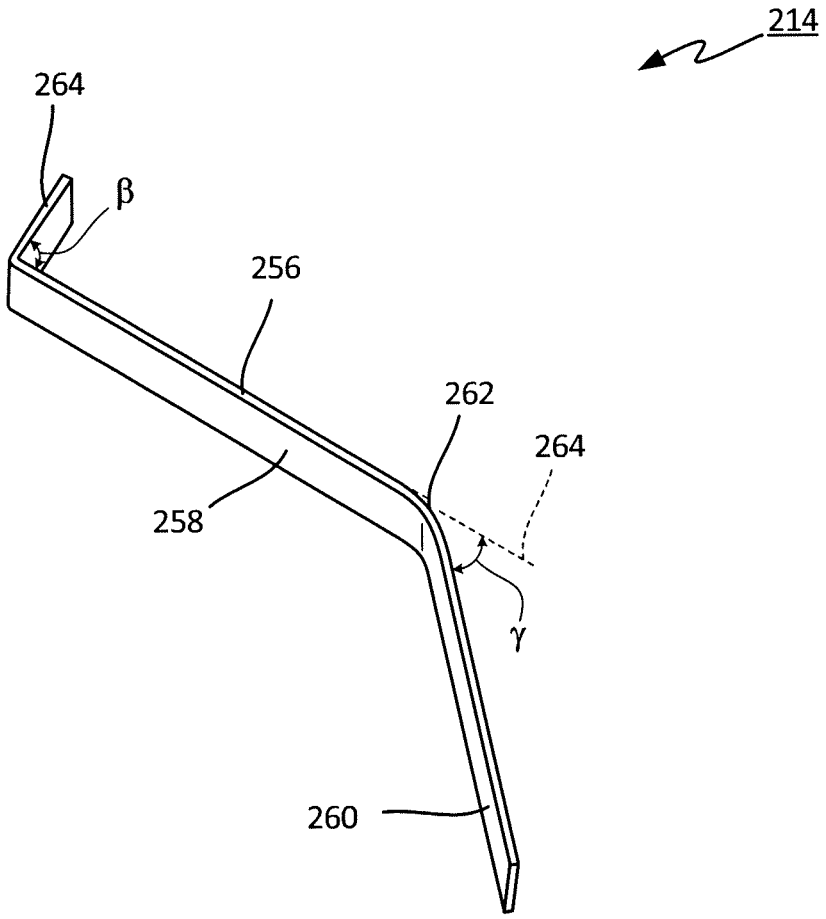
FIG. 18 is a perspective view of an elliptical leaf spring.
Figure 19A:
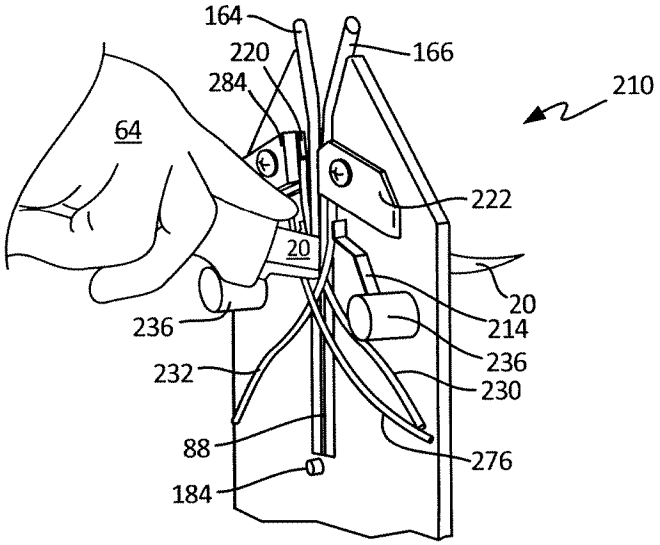
FIG. 19A is a partial perspective view of the knife sharpener of FIG. 15 with the sharpening steels and wiper rod in their standby positions, and the knife blade first engaging the sharpening steels.
Figure 19B:
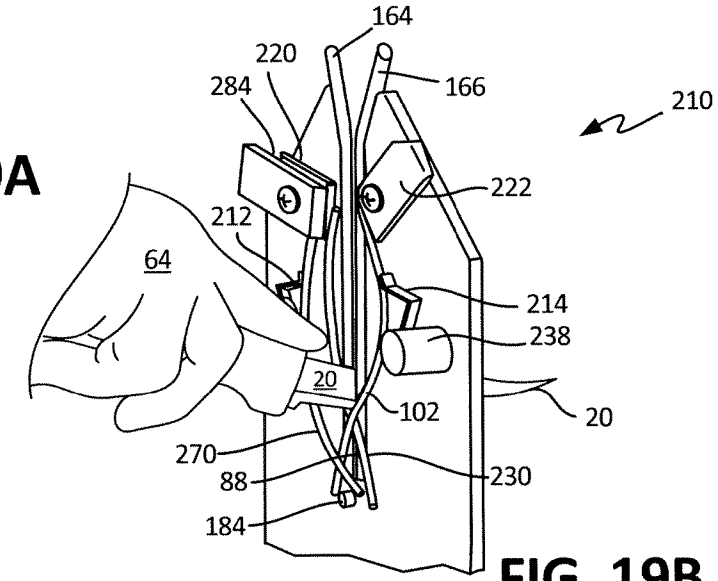
FIG. 19B is a partial perspective view of the knife sharpener of FIG. 19A with the knife blade further progressed along the sharpening steels and wiper rod.

As shown in FIG. 16, located on the panel member 80 near the left edge 82 and right edge 84 are a pair of D-shaped niches 216 and 217. These niches extend only partially through the width of the panel member 80 and feature a flat surface. The niches 216 and 217 should be positioned the same distance $D_{11}$, from the edge of the panel member 80, and the same distance $D_{12}$ from the top edge 90 of the panel member.

Pivotably mounted upon the panel member 80 is a pair of attachment tabs 220 and 222. These attachment tabs 220 and 222 comprise a thickened piece of stainless steel material approximately 100/1000-inch thick having equal masses. Holes 224 and 226 are formed within attachment tabs 220 and 222, respectively. These holes 224 and 226 are positioned equal distances from the inside edge of the attachment tabs and the top edge of the attachment tabs.

A threaded insert (not shown) is fitted inside left through hole 99 and right through hole 101 in panel member 80. Bolts 158 having a threaded shank extend through holes 220 and 222 in the attachment tabs 220 and 222, respectively, and into threaded engagement with the threaded inserts of the throughholes to pivotably mount the attachment tabs to the panel board. These bolts 158 define the rotational axes for the attachment tabs.

A pair of sharpening steels 230 and 232 are fixedly connected along their attachment ends 106 to the inside edges of attachment tabs 220 and 222, respectively. As shown in FIG. 15, the left-hand sharpening steel 100 and right-hand sharpening steel 102 overlay panel member 80. These two sharpening steels each have a roughly circular cross section, although other shapes like an oval or triangle may be used. The sharpening steels 100 and 102 extend toward each other in criss-crossed relation, intersecting at point 160 along slot 88. The sharpening steels 230 and 232 have the same structure and geometry as sharpening steels 100 and 102 described above for the knife sharpener embodiment 60.

Extending upwards from the surface of panel member 80 of knife sharpener 210 near the left edge 82 and right edge 84, as shown in FIG. 15, are stationary cams 236 and 238, respectively. These stationary cams may bear any suitable shape such as a cylinder or cube. As shown more clearly in FIGS. 17A and 17B, each cam bears an exterior surface 240 and a bottom surface 242. A cut-out niche 244 formed in the side wall causes bottom surface 242 to be D-shaped. A slot 246 extends vertically within the cam from the bottom surface 242.

The stationary cams 236 and 238 are press-fitted into left niche 250 and right niche 252, respectively, in panel member 80. The perimeter and surface area of the bottom surface 242 of the cam is slightly larger than the perimeter and bottom surface area of the panel member niche, so that the cam is securely connected to the panel board 80 without the need for a bolt or screw that could otherwise provide a breeding ground for bacteria. The cooperating straight side and corners of the D-shaped profiles of the cams and niches act to inhibit the cam from rotating within respect to the panel member. This stationary feature for the cam ensures that slot 246 will be maintained at an approximately 35 degree angle with respect to slot 88 on the panel member 80.

Once attachment clips 220 and 222 are secured to panel member 80 as described above, the arced upper segment 104 of the sharpening steels 230 and 232 curves along and above the top surface of panel member 80, passing over slot 88. Meanwhile, straight intermediate segment 108 of sharpening steel 100, 102 passes along and above the top surface of panel member 80 below cams 236 and 238. Distal end 110 of the sharpening steel 230 and 232 extends beyond the cams. As shown in FIG. 15, sharpening steel 232 is positioned above sharpening steel 230, so that they cross over each other at intersection point 160 over slot 88.

The knife sharpener 210 also comprises elliptical leaf springs 212 and 214. As shown more clearly in FIG. 18, elliptical leaf spring 214 comprises a rectangular strip 256 of metal material having the required combination of rigidity and elasticity to act like a spring. The strip 256 comprises a first segment 258 that leads into a second segment 260 along a bend 262. Tail 264 is connected to the end of first segment 258, bent away from the first segment at an angle $\beta$ of about 100-110 degrees, preferably about 102-106 degrees, most preferably about 104 degrees. Second segment 260 is bent away from first segment 258 at an angle $\gamma$ with respect to tangent line about 264 of 9-36 degrees, preferably about 15-20 degrees, most preferably about 18 degrees. Such an elliptical leaf spring 214 is made from "spring steel" material that may be sourced from W.S. Grainger, Inc. of Lake Forest, Ill., or McMaster-Carr Supply Company of Elmhurst, Ill. Elliptical leaf spring 212 is manufactured in the same manner as elliptical spring leaf 214, as described above.

As shown in FIG. 15, elliptical leaf springs 212 and 214 are assembled onto knife sharpener 210 with the end of their respective second segments 260 inserted into slot 246, of cams 236 and 238. When the cam with the end of the leaf spring inserted into the slot is press fitted into the niche in the panel member, the two portion of the body of the cam adjacent to the slot will be pushed towards each other by the perimeter walls of the niche, thereby tightly holding the spring end in place. Extending from the cams with their respective first and second segments positioned above panel member 80, their first tails 264 abut the arced upper segments 104 of sharpening steels 230 and 232.

When the sharpening steels 230 and 232 are in their standby position, elliptical leaf springs 212 and 214 push the sharpening steels 230 and 232 upwardly towards the top edge 90 of panel with intermediate segments 108 abutting stationary cams 236 and 238, respectively, to hold the sharpening steels in a stationary position. As shown in FIG. 18A, the user 62 inserts knife blade 20 into slot 88 of the panel member 80 from its top edge 90, and pushes the knife blade 20 down through the slot until it meets intersection point 160 of the two sharpening steels 230 and 232. Continued application by hand 64 of downwards force upon knife blade 20 causes the intersection point 160 of the sharpening steels 230 and 232 to likewise move in a downwards direction, as shown in FIG. 18B. The upper curved segments 104 of the sharpening steels will bow outwardly against tails 264 of leaf springs 212 and 214, while the terminal segments 109 are drawn towards each other until they or the distal ends 110 of the sharpening steels come into contact with stop post 184 extending from the top surface of panel member 80. At the same time, the user's hand 64 draws the knife blade towards the user so that the beveled edges 44 of the knife blade 20 are slid along the intermediate segments 108 of the sharpening steels 230 and 232. In this matter, deformed edges 52 of the knife blade 20 are realigned to produce a sharpened cutting edge 28. When pressure is applied on the knife blade against the hard sharpening steels, it causes the blade's metal to yield to the harder sharpening steel metal or ceramic material of the sharpening steel to become realigned and thus sharpened. The elliptical leaf springs 212 and 214 provide impedance against the downwards movement of the sharpening steels 230 and 232 to prolong the contact by the knife blade with the sharpening steels.

The slot 88 of the panel member 80 properly orients the knife blade 20 with respect to the sharpening steels 230 and 232. The leaf springs orient the sharpening steels with respect to the slot and knife blade, and keep proper tension on the sharpening steels during the sharpening operation. The stationary cams properly orient the springs at an angle of about 35 degrees with respect to the slot.

The angle ε at the intersection point 160 of the criss-crossed sharpening steels should be about 50-80 degrees, preferably about 65-75 degrees, most preferably about 70 degrees. Moreover, this intersection angle ε will be roughly maintained throughout the sharpening operation. It has been found that this angle allows the cutting edge of the knife blade to be sharpened at the correct angle for that knife without any need to match angles between the cutting edge and sharpening steels or make adjustments to the sharpening device, as is required by prior art devices. The distances $D_5$ and $D_6$ for the placement of the through holes 99 and 101 in the panel board 80, and the distances for placement of the holes 224 and 226 in the attachment tabs 220 and 222 should be correctly defined at the point of manufacture to produce this desired intersection angle ε for the sharpening steels 230 and 232 pivotably mounted to the panel member via the attachment tabs.

Yet, the sharpening steel surface must also be super smooth in order to avoid further damage and deformation caused by the sharpening steel to the knife blade that could cause unwanted burrs along the blade edge. Thus, the sharpening steels do not function like grinding wheels, whetstones, or hones that are commonly used to remove metal burrs from a blade before it can be sharpened. At the same time, the two sharpening steels 230 and 232 simultaneously treat the opposite beveled edges 44 of the knife blade to realign the cutting edge 28. Because of the cylindrical surface of the sharpening steels 230 and 232, they sharpen the cutting edge without any need to maintain the knife blade at a specified angle with respect to the sharpening surface unlike with prior art processes. This enables unskilled persons to sharpen knife blades using the knife sharpener device 60 of the present invention.

Optionally attached to knife sharpener 210 is wiper rod 270. Constituting a sharpening steel in its own right, it has a gradually curved main body 272 with an attachment end 274 and a distal end 276. The attachment end 274 is secured to a counterweight 278 comprising a slab 280 of metal with a hole 282 in it. Counterweight 278 is secured to panel 80 by means of a bolt extending through the hole 282 and a corresponding hole (not shown) in the panel 80. As shown in FIG. 15, the same bolt 284 may be used to secure both attachment tab 220 and counterweight 278 to panel member 80. Counterweight 1278 only weighs 2-6 ounces, preferably 3 ounces. This is much lighter than the counterweights used in the MOUSETRAP STEEL prior art knife sharpener that weigh 20 ounces each.

When assembled, the curved body 272 of wiper rod 270 extends from its attached end 274 and counterweight 278 over and above panel member 80 and sharpening steel 230 and slot 88 with its distal end 276 extending adjacent to or past right edge 84 of panel 80 (see FIG. 15). When the knife blade 20 is pushed downwards through slot 88 to contact the sharpening steels 230 and 232 at intersection point 160 (see FIG. 19A), and continued to push the sharpening steels in a downwards direction (see FIG. 19B), the knife blade 20 will contact wiper rod 270 to also push it down. By drawing the knife blade along wiper rod 270 in addition to sharpening steels 230 and 232, the wiper rod 270 will act to polish the sharpened cutting edge 28 produced by the sharpening steels 230 and 232 to further straighten any imperfections along the cutting edge. At the same time, counterweight 278 provides impedance against the downward movement of the wiper rod to prolong the contact by the knife blade with the wiper rod. There is no leaf spring biasing the wiper rod.

When the knife blade is withdrawn from the slot 88 in the knife sharpener 210, the tails 264 of the elliptical leaf springs 212 and 214 will act to bias sharpening steels 230 and 232, respectively, back to their stand-by position shown in FIG. 18A. Meanwhile, counterweight 278 acts to return wiper rod 270 to its standby position. The knife sharpener 210 is now ready to sharpen the cutting edge along the blade 20 of the same knife 10 or another knife.

Sharpening steels normally cannot repair burrs or other severely deformed regions along a knife blade cutting edge. They just realign less severely deformed regions. However, in the case of the present invention, the sharpening steels 230 and 232 allow such a repair step to be carried out. A bend 111 exists within the sharpening steel 230 and 232 where the straight intermediate segment 108 joins the terminal segment 109. This bend provides additional surface area on the sharpening steel. As seen in FIG. 18B, the stop post 184 is properly located on the panel member 80 so that when the terminal segments 109 or distal ends 110 of the sharpening steels abut the stop post to arrest the inward movement of the steels when the knife blade is pressing down on the steels, the intersection point 160 of the criss-crossed sharpening steels is defined by the two bend points 111. When the knife blade 20 is pushed down in the slot 88 to engage this intersection point 160, the stop post 184 will lock the two sharpening steels in place so that further pressure is applied by the bends 111 of the sharpening steels against the burr or severely deformed region of the cutting edge of the knife blade to repair it. The polished exterior of the sharpening steels and locked position of the steels produces this extra sharpening capacity by the knife sharpener 210.

The above specification and associated drawings provide a complete description of the structure and operation of the scissors sharpener of the present invention. Many alternative embodiments of the invention can be made without departing from the spirit and scope of the invention. Therefore, the invention resides in the claims herein appended.

I claim:

1. A knife sharpener for sharpening the blade of a knife used to cut a substrate, said knife having a blade with opposed cutting edges, said knife sharpener comprising:

(a) a panel member having a front surface and a top edge, and an elongated slot extending partially therein from the top edge and defined by a left edge and a right edge;

(b) a pair of counterweights, each of which is pivotably secured to the panel member at a pivot point adjacent to and on opposite sides of the upper end portion of the slot;

(c) a pair of sharpening steels having an upper attachment end, a curved upper segment extending downwardly from the upper attachment end, and a straight lower end segment extending downwardly from the curved upper segment, each of the sharpening steels being connected at its attachment end to one of the counterweights pivotably secured to the panel member, and each of the sharpening steels being swingable downwardly in crossed relation about its pivot point along the slot in a plane adjacent and parallel to the plane of the panel member, the crossed relation defining an intersection point;

(d) at least one U-shaped guard wire mounted to the front face of the panel member having an upper leg, a lower leg, and a central section therebetween, the guard wire overlaying one of the sharpening steels to protect it from becoming disengaged from the panel member;

(e) at least one secondary steeling rod attached to the left edge or right edge of the slot of the panel member;

(f) wherein the counterweights pull the crossed sharpening steels upwardly into their standby position with their lower edge resting upon the upper leg of the guard wire when the knife blade is not engaged;

(g) wherein as the knife blade is pushed downwardly in the slot of the panel member to contact the intersection point of the crossed sharpening steels, the intersection point is moved lower along the slot, bowing the sharpening steels under tension applied by the weight of the counterweights, the sharpening steels sharpening the opposing cutting edges of the knife blade as the knife blade is drawn downwardly, outwardly, and through the slot; and (h) wherein as the knife blade is pushed downwardly in or drawn through the slot of the panel member, the one or more secondary steeling rods attached to the left edge or right edge of the slot act to guide the knife blade through the slot in proper orientation with respect to the sharpening steels, and protect the knife blade from damage caused by the exposure to the left edge or right edge of the slot of the panel member.

2. The knife sharpener of claim 1 wherein the one or more secondary steeling rods further act to sharpen the cutting surface of the knife blade if the knife blade comes into contact with the secondary steeling rod as it is pushed downwardly in or drawn through the slot of the panel member.

3. The knife sharpener of claim 1, wherein an angle defined by the intersection point of the crossed sharpening steels is about 50-80 degrees.

4. The knife sharpener of claim 3, wherein the angle is about 70 degrees.

5. The knife sharpener of claim 1, wherein the attachment tabs of the sharpening steels are mounted to the panel member at positions on adjacent sides of the slot to define and maintain the angle of the intersection point of the crossed sharpening steels.

6. The knife sharpener of claim 1, wherein the sharpening steels are made from hardened steel, stainless steel, stainless steel-carbon alloy, diamond-coated steel, or ceramic material.

7. The knife sharpener of claim 1, wherein the sharpening steels have a cross-sectional shape of a circle, oval, or triangle.

8. The knife sharpener of claim 1 further comprising a stop post mounted to the face of the panel member and below the slot for arresting the inward movement of the sharpening steels during the knife sharpening operation.

9. The knife sharpener of claim 1 further comprising a straight terminal segment extending downwardly from the straight lower end segment at a bend point on the sharpening steel, wherein when the bend points on the two crossed sharpening steels define the intersection point, and the knife is pushed downwardly in the slot of the panel member to contact the intersection point, a more severely damaged region along the cutting edge of the knife blade can be repaired as it is drawn downwardly, outwardly and through the slot.

10. The knife sharpener of claim 9, wherein an angle defined at the bend in the sharpening steel between the terminal segment and a tangent line extending from the lower end segment is about 36-70 degrees.

11. The knife sharpener of claim 10, wherein the angle is about 48 degrees.

12. The knife sharpener of claim 1 further comprising a wiper rod having an upper attachment end, and a curved segment extending downwardly from the upper attachment end, the wiper rod being connected at its attachment end to a counterweight pivotably secured to the panel member, and the wiper rod being swingable downwardly about its pivot point along the slot in a plane adjacent and parallel to the plane of the panel member, wherein the wiper rod comes into contact with the knife blade during the sharpening operation to polish the cutting edges sharpened by the sharpening steels.

13. The knife sharpener of claim 1, wherein the cut substrate comprises paper, cardboard, metal foil, thin plastic, textiles, cloth, silk, rope, twine, wire, wood veneers, wood, construction materials, flowers, tree or plant part, or foods like meats.

14. The knife sharpener of claim 1, wherein the knife comprises a knife used as a dining utensil or in food preparation like a bread knife, boning knife, carving knife, chef's knife, cleaver, butcher's knife, electric knife, kitchen knife, oyster knife, paring or coring knife, rocker knife, steak knife, table knife, or ulu; a knife used as a tool like a Bowie knife, cobbler's or shoemaker's knife, crooked knife, wood carving knife, diver's knife, electrician's knife, hunting knife, linoleum knife, machete, palette knife, paper knife or letter opener, pocket knife, produce knife, rigging knife, scalpel, straight razor, survival knife, switchblade, utility knife, whittling knife, x-acto knife, balisong, or kiridashi; a knife used as a weapon like a ballistic knife, bayonet, combat knife, dagger, fighting knife, ramuri, shiv, trench knife, butterfly knife, or throwing knife; or a knife used in religious ceremonies like an athame, kirpen, kilaya, kris, kukri, puukko, seax, or sgiandubh.

15. The knife sharpener of claim 1, wherein the included angle of the knife blade to be sharpened is about 20-80 degrees.

16. A knife sharpener for sharpening the blade of a knife used to cut a substrate, said knife having a blade with opposed cutting edges, said knife sharpener comprising:

(a) a panel member having a front surface and a top edge, and an elongated slot extending partially therein from the top edge and defined by a left edge and a right edge;

(b) a pair of attachment tabs, each of which is pivotably secured to the panel member at a pivot point adjacent to and on opposite sides of the upper end portion of the slot;

(c) a pair of sharpening steels having an upper attachment end, a curved upper segment extending downwardly from the upper attachment end, and a straight lower end segment extending downwardly from the curved upper segment, each of the sharpening steels being connected at its attachment end to one of the attachment tabs secured to the panel member, and each of the sharpening steels being swingable downwardly in crossed relation about its pivot point along the slot in a plane adjacent and parallel to the plane of the panel member, the crossed relation defining an intersection point;

(d) a pair of cams mounted to the front face of the panel member having a vertical slot therein;

(e) a pair of leaf springs having a first end and a second end, the first end being secured by the vertical slot in one of the cams, and the second end terminating in a bearing surface, the bearing surface of a spring abutting one of the sharpening steels to place tension on and impede the movement of the sharpening steel;

(f) at least one secondary steeling rod attached to the left edge or right edge of the slot of the panel member;

(g) wherein the leaf springs push the crossed sharpening steels upwardly into their standby position when the knife blade is not engaged;

(h) wherein as the knife blade is pushed downwardly in the slot of the panel member to contact the intersection point of the crossed sharpening steels, the intersection point is moved lower along the slot, bowing the sharpening steels under tension against the bearing surface of the leaf springs, the sharpening steels sharpening the opposing cutting edges of the knife blade as the knife blade is drawn downwardly, outwardly, and through the slot; and (i) wherein as the knife blade is pushed downwardly in or drawn through the slot of the panel member, the one or more secondary steeling rods attached to the left edge or right edge of the slot act to guide the knife blade through the slot in proper orientation with respect to the sharpening steels, and protect the knife blade from damage caused by the exposure to the left edge or right edge of the slot of the panel member.

17. The knife sharpener of claim 16 further comprising at least one U-shaped wing mounted to the front face of the panel member having an upper leg, a lower leg, and a central section therebetween, the wing overlaying one of the sharpening steels to protect it from becoming disengaged from the panel member.

18. The knife sharpener of claim 16, wherein the cams maintain the leaf spring at an angle with respect to the slot in the panel member of about 35 degrees.

19. The knife sharpener of claim 16, wherein the cams are mounted in a stationary manner to the panel member to prevent the leaf springs from pivoting with respect to the sharpening steels during the knife sharpening operation.

20. The knife sharpener of claim 16, wherein the leaf spring comprises a first segment and a second segment with a bend in between, an angle defined at the bend between the first segment and a tangent line extending from the second segment of about 9-36 degrees.

21. The knife sharpener of claim 16, wherein the angle defined by the bend between the first segment and the bearing surface of the leaf spring is about 100-110 degrees.

22. The knife sharpener of claim 16, wherein an angle defined by the intersection point of the crossed sharpening steels is about 50-80 degrees.

23. The knife sharpener of claim 22, wherein the angle is about 70 degrees.

24. The knife sharpener of claim 16, wherein the attachment tabs of the sharpening steels are mounted to the panel member at positions on adjacent sides of the slot to define and maintain the angle of the intersection point of the crossed sharpening steels.

25. The knife sharpener of claim 16, wherein the sharpening steels are made from hardened steel, stainless steel, stainless steel-carbon alloy, diamond-coated steel, or ceramic material.

26. The knife sharpener of claim 16, wherein the sharpening steels have a cross-sectional shape of a circle, oval, or triangle.

27. The knife sharpener of claim 16 further comprising a stop post mounted to the face of the panel member and below the slot for arresting the inward movement of the sharpening steels during the knife sharpening operation.

28. The knife sharpener of claim 16 further comprising a straight terminal segment extending downwardly from the straight lower end segment at a bend point on the sharpening steel, wherein when the bend points on the two crossed sharpening steels define the intersection point, and the knife is pushed downwardly in the slot of the panel member to contact the intersection point, a more severely damaged region along the cutting edge of the knife blade can be repaired as it is drawn downwardly, outwardly and through the slot.

29. The knife sharpener of claim 28, wherein an angle defined at the bend in the sharpening steel between the terminal segment and a tangent line extending from the lower end segment is about 36-70 degrees.

30. The knife sharpener of claim 29, wherein the angle is about 48 degrees.

31. The knife sharpener of claim 16 further comprising a wiper rod having an upper attachment end, and a curved segment extending downwardly from the upper attachment end, the wiper rod being connected at its attachment end to a counterweight pivotably secured to the panel member, and the wiper rod being swingable downwardly about its pivot point along the slot in a plane adjacent and parallel to the plane of the panel member, wherein the wiper rod comes into contact with the knife blade during the sharpening operation to polish the cutting edges sharpened by the sharpening steels.

32. The knife sharpener of claim 16 further comprising a handle connected to the bottom edge of the panel member.

33. The knife sharpener of claim 16, wherein the knife sharpener is sufficiently small and portable to be worn on the person of the user.

34. The knife sharpener of claim 16, wherein the cut substrate comprises paper, cardboard, metal foil, thin plastic, textiles, cloth, silk, rope, twine, wire, wood veneers, wood, construction materials, flowers, tree or plant part, or foods like meats.

35. The knife sharpener of claim 16, wherein the knife comprises a knife used as a dining utensil or in food preparation like a bread knife, boning knife, carving knife, chef's knife, cleaver, butcher's knife, electric knife, kitchen knife, oyster knife, paring or coring knife, rocker knife, steak knife, table knife, or ulu; a knife used as a tool like a Bowie knife, cobbler's or shoemaker's knife, crooked knife, wood carving knife, diver's knife, electrician's knife, hunting knife, linoleum knife, machete, palette knife, paper knife or letter opener, pocket knife, produce knife, rigging knife, scalpel, straight razor, survival knife, switchblade, utility knife, whittling knife, x-acto knife, balisong, or kiridashi; a knife used as a weapon like a ballistic knife, bayonet, combat knife, dagger, fighting knife, ramuri, shiv, trench knife, butterfly knife, or throwing knife; or a knife used in religious ceremonies like an athame, kirpen, kilaya, kris, kukri, puukko, seax, or sgiandubh.

36. The knife sharpener of claim 16, wherein the included angle of the knife blade to be sharpened is about 20-80 degrees.

* * * * *